US008530736B2

(12) United States Patent
Liu et al.

(10) Patent No.: US 8,530,736 B2
(45) Date of Patent: Sep. 10, 2013

(54) MUSICAL TONE SIGNAL SYNTHESIS METHOD, PROGRAM AND MUSICAL TONE SIGNAL SYNTHESIS APPARATUS

(75) Inventors: Encai Liu, Hamamatsu (JP); Masatsugu Okazaki, Hamamatsu (JP); Eiji Tominaga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/310,099

(22) Filed: Dec. 2, 2011

(65) Prior Publication Data

US 2012/0137857 A1 Jun. 7, 2012

(30) Foreign Application Priority Data

Dec. 2, 2010 (JP) ..... 2010-269811

(51) Int. Cl.
*G10H 7/00* (2006.01)

(52) U.S. Cl.
USPC ..... 84/622; 84/623; 84/626; 84/659; 703/2; 700/94

(58) Field of Classification Search
USPC ..... 84/622, 623, 626, 659; 703/2; 700/94
See application file for complete search history.

(56) References Cited

U.S. PATENT DOCUMENTS 3,830,952 A * 8/1974 Kitchen ..... 84/702
4,133,241 A * 1/1979 Niimi et al. ..... 84/607
4,175,465 A * 11/1979 Schmoll, III ..... 84/698
4,418,601 A * 12/1983 Whitefield ..... 84/627
5,144,096 A * 9/1992 Kunimoto ..... 84/659
5,167,179 A * 12/1992 Yamauchi et al. ..... 84/618
5,206,448 A * 4/1993 Kunimoto ..... 84/659
5,223,657 A * 6/1993 Takeuchi ..... 84/661
5,229,536 A * 7/1993 Kunimoto ..... 84/658
5,241,127 A * 8/1993 Kobayashi ..... 84/616

(Continued)

FOREIGN PATENT DOCUMENTS

JP 3-181994 A 8/1991
JP 9-222890 A 8/1997
WO WO-2008/012412 A2 1/2008
WO WO-2008/012412 A3 1/2008

OTHER PUBLICATIONS

Bensa, J. et al. (Aug. 2003). "The Simulation of Piano String Vibration: From Physical Models to Finite Difference Schemes and Digital Waveguides," *J. Acous. Soc. Am.* 114(2):1095-1107.

(Continued)

*Primary Examiner* — David S. Warren
(74) *Attorney, Agent, or Firm* — Morrison & Foerster LLP

(57) ABSTRACT

A musical tone signal is synthesized based on performance information to simulate a sound generated from a musical instrument having a string and a body that supports the string by a support. There is provided a closed loop circuit having a delay element that simulates delay characteristic of vibration propagated through the string and a characteristic control element that simulates a variation in amplitude or frequency. A string model calculation circuit inputs an excitation signal based on the performance information to the closed loop circuit, and calculates first information representing a force of the string acting on the support based on a cyclic signal generated in the closed loop and representing the vibration of the string circuit. A body model calculation circuit calculates second information representing a displacement of the body or a derivative of the displacement. A musical tone signal calculation circuit calculates the musical tone signal.

6 Claims, 19 Drawing Sheets

(56) References Cited

U.S. PATENT DOCUMENTS

| | | | | |
|---|---|---|---|---|
| 5,241,129 | A * | 8/1993 | Muto et al. | 84/625 |
| 5,245,127 | A * | 9/1993 | Yamauchi et al. | 84/624 |
| 5,256,830 | A * | 10/1993 | Takeuchi et al. | 84/625 |
| 5,272,276 | A * | 12/1993 | Okamoto et al. | 84/737 |
| 5,286,915 | A * | 2/1994 | Komano et al. | 84/658 |
| 5,290,969 | A * | 3/1994 | Kobayashi | 84/622 |
| 5,304,734 | A * | 4/1994 | Kunimoto | 84/661 |
| 5,308,918 | A * | 5/1994 | Yamauchi et al. | 84/622 |
| 5,315,058 | A * | 5/1994 | Okamoto et al. | 84/626 |
| 5,352,849 | A * | 10/1994 | Kobayashi | 84/659 |
| 5,371,317 | A * | 12/1994 | Masuda | 84/659 |
| 5,403,969 | A * | 4/1995 | Muto | 84/622 |
| 5,426,262 | A * | 6/1995 | Kitayama et al. | 84/622 |
| 5,428,185 | A * | 6/1995 | Kunimoto et al. | 84/658 |
| 5,451,707 | A * | 9/1995 | Suzuki | 84/604 |
| 5,466,884 | A * | 11/1995 | Van Duyne et al. | 84/661 |
| 5,468,906 | A * | 11/1995 | Colvin et al. | 84/625 |
| 5,500,486 | A * | 3/1996 | Smith, III | 84/622 |
| 5,508,469 | A * | 4/1996 | Kunimoto et al. | 84/603 |
| 5,512,705 | A * | 4/1996 | Kobayashi | 84/622 |
| 5,521,325 | A * | 5/1996 | Takeuchi et al. | 84/624 |
| 5,521,329 | A * | 5/1996 | Yamauchi et al. | 84/661 |
| 5,536,903 | A * | 7/1996 | Kitayama et al. | 84/660 |
| 5,587,548 | A * | 12/1996 | Smith, III | 84/659 |
| 5,614,686 | A * | 3/1997 | Van Duyne et al. | 84/622 |
| 5,641,931 | A * | 6/1997 | Ogai et al. | 84/661 |
| 5,717,155 | A * | 2/1998 | Szalay | 84/723 |
| 5,731,533 | A * | 3/1998 | Hoshiai | 84/661 |
| 5,750,912 | A * | 5/1998 | Matsumoto | 84/609 |
| 5,763,803 | A * | 6/1998 | Hoshiai et al. | 84/626 |
| 5,981,860 | A * | 11/1999 | Isozaki et al. | 84/603 |
| 6,005,180 | A * | 12/1999 | Masuda | 84/622 |
| 6,049,034 | A * | 4/2000 | Cook | 84/736 |
| 6,111,181 | A * | 8/2000 | Macon et al. | 84/603 |
| 6,175,073 | B1 * | 1/2001 | Kitayama | 84/661 |
| 6,284,965 | B1 * | 9/2001 | Smith et al. | 84/661 |
| RE37,422 | E * | 10/2001 | Yamada et al. | 84/600 |
| 6,448,488 | B1 * | 9/2002 | Ekhaus et al. | 84/735 |
| 6,647,359 | B1 * | 11/2003 | Verplank et al. | 703/2 |
| 7,259,315 | B2 * | 8/2007 | Tamura et al. | 84/627 |
| 7,381,881 | B1 * | 6/2008 | Sapp | 84/622 |
| 7,534,953 | B2 * | 5/2009 | Kergomard et al. | 84/659 |
| 7,812,243 | B2 * | 10/2010 | Celi et al. | 84/723 |
| 7,915,515 | B2 * | 3/2011 | Guillaume | 84/735 |
| 8,115,092 | B2 * | 2/2012 | Tominaga | 84/719 |
| 2003/0188627 | A1 * | 10/2003 | Longo | 84/627 |
| 2006/0065108 | A1 * | 3/2006 | Kergomard et al. | 84/659 |
| 2009/0241757 | A1 * | 10/2009 | Guillaume | 84/608 |
| 2009/0320671 | A1 * | 12/2009 | Meeks et al. | 84/735 |
| 2010/0242710 | A1 * | 9/2010 | Ide et al. | 84/622 |
| 2010/0307322 | A1 * | 12/2010 | Tominaga | 84/622 |
| 2010/0313740 | A1 * | 12/2010 | Ryle et al. | 84/735 |
| 2012/0111178 | A1 * | 5/2012 | Tominaga | 84/622 |
| 2012/0137857 | A1 * | 6/2012 | Liu et al. | 84/622 |
| 2012/0174736 | A1 * | 7/2012 | Wang et al. | 84/622 |
| 2012/0174737 | A1 * | 7/2012 | Risan | 84/622 |
| 2012/0204705 | A1 * | 8/2012 | Nakayama | 84/744 |
| 2012/0240750 | A1 * | 9/2012 | Kakishita | 84/604 |
| 2012/0272814 | A1 * | 11/2012 | Menzies-Gow | 84/724 |

OTHER PUBLICATIONS

Giordano, N. (2004). "Physical Modeling of the Piano," *EURASIP Journal on Applied Signal Processing* 7:926-933.

Pedersini, F. et al. (Nov. 2000). "Object-Based Sound Synthesis for Virtual Environments," *IEEE Signal Processing Magazine*, pp. 37-51.

Akio, N. (1985). "Mode Analysis," *Baifukan*, pp. 86-89. (with English Translation, 10 pages.).

Anonymous. (1990). Chapter 6.4, "Advanced Composite Materials," The Japan Society of Mechanical Engineers, pp. 68-70. (with English Translation, seven pages.).

Anonymous. (2003). "Basics and Applications of Numerical Integration," *The Japan Society of Mechanical Engineers*, pp. 86-95. (with English Translation, 19 pages.).

Ellis, J. (May 1998). "Longitudinal Modes in Piano Strings: Results of New Research," *Piano Technical Journal*, pp. 16-23.

Yukio, K. (1981). "Engineering According to Finite Element Method/Basics and Applications," *Baifukan*, pp. 64-67. (with English Translation, four pages.).

* cited by examiner

MUSICAL TONE SIGNAL SYNTHESIS METHOD, PROGRAM AND MUSICAL TONE SIGNAL SYNTHESIS APPARATUS

BACKGROUND OF THE INVENTION

1. Technical Field of the Invention

The present invention relates to a technology for synthesizing a musical tone signal by performing a simulation according to a predetermined physical model on the basis of a sounding mechanism of a natural musical instrument. Particularly, the invention relates to a musical tone signal synthesis method, a program and a musical tone signal synthesis apparatus suitable to generate a musical tone signal that realistically expresses characteristics of a sound generated from a musical instrument having a three-dimensional structure having a string and a main body (a component that supports the string and emits a sound to the air).

2. Description of the Related Art

There is known a method for synthesizing a musical tone of a natural musical instrument in a pseudo or virtual manner according to a predetermined physical model based on a sounding mechanism of the natural musical instrument in a dedicated hardware system including a general purpose computer, a digital signal processing apparatus such as a digital signal processor (DSP), an integrated circuit, a large-scale integrated circuit, etc. When a pseudo piano sound needs to be generated, for example, a musical tone signal is synthesized by executing a simulating operation in a general purpose computer on the basis of a string physical model. For instance, there is a musical tone signal synthesis apparatus that synthesizes a musical tone signal based on a cyclic signal generated by inputting an excitation signal to a closed loop using a delay element. This musical tone signal synthesis apparatus is described in Patent Reference 1 and Patent Reference 2, for example.

[Patent Reference 1] Japanese Patent Publication No. 2820205

[Patent Reference 2] Japanese Patent Publication No. 2591198

One end of a piano string is supported by a bearing on a frame corresponding to a part of the main body of a piano, and the other end thereof is supported by a bridge on a sound board corresponding to a part of the main body. When a key is pressed, a string corresponding to the key is released from a damper and, simultaneously, kinetic energy is applied to a hammer. When the hammer strikes the string, some of energy of wave excited in the string is transmitted to the main body via the string supports and the remainder is reflected at the string supports to remain in the string. The wave generated in the string repeatedly reciprocates between the string supports to generate vibration. While vibration in a direction perpendicular to the axial direction of the string, that is, bending vibration is initially generated in a direction in which the string is stroke by the hammer, vibration is generated even in a direction perpendicular to the direction in which the string is stroke by the hammer due to the influence of the bridge which moves three-dimensionally. The string generates vibration in the axial direction of the string, that is, longitudinal vibration, in addition to the bending vibrations in the two directions.

The piano generates a full stereoscopic characteristic musical tone by vibrating not only the string but also the main body having a complicated three-dimensional shape including a sound board, a frame, a pillar, a side board, a deck, etc.

However, there has not been proposed a method (calculation algorithm) for realistically expressing characteristics of a musical tone generated from the piano that is a structure having a string corresponding to a part for generating a musical scale, and a main body corresponding to a part for supporting the string and emitting a sound to the air.

SUMMARY OF THE INVENTION

An object of the present invention is to provide a musical tone signal synthesis method, a program and a musical tone signal synthesis apparatus, capable of generating a pseudo musical instrument sound that realistically expresses characteristics of a sound generated from a musical instrument in a three-dimensional structure having a string and a main body.

To accomplish the object of the invention, the present invention provides a musical tone signal synthesis method of synthesizing a musical tone signal based on performance information, the musical tone signal simulating a sound generated from a musical instrument having a three-dimensional structure including a string that undergoes vibration and a main body having two string supports, between which the string is stretched, the vibration traveling from the string to the main body through at least one of the string supports. The musical tone signal synthesis method comprises: a string model calculation process of inputting an excitation signal based on the performance information to a closed loop having a delay element that simulates delay characteristic of the vibration propagated through the string and a characteristic control element that simulates a variation in amplitude characteristics or frequency characteristics associated to propagation of the vibration, and calculating first information representing a force of the string acting on at least one of the string supports on the basis of a cyclic signal circulating in the closed loop and representing the vibration of the string; a main body model calculation process of calculating second information representing, on modal coordinates, a displacement of each vibration mode of the main body or representing an nth order derivative (n=1, 2, . . . ) of the displacement with time, on the basis of an equation of motion that represents the vibration of the main body caused by the force of the string represented by the first information; and a musical tone signal calculation process of calculating the musical tone signal on the basis of the second information.

In a preferred aspect of the invention, the main body model calculation process calculates, on the basis of the second information, third information that represents a displacement of at least one of the string supports or an nth order derivative of the displacement thereof (n=1, 2, . . . ) with time, and the string model calculation process inputs an excitation signal based on the third information to the closed loop in addition to the excitation signal based on the performance information.

In another preferred aspect of the invention, the musical instrument is a piano having a key depressed to collide with the main body and a hammer that strikes a specific point of the string according to depression of the key, wherein the method further comprises a hammer model calculation process of calculating fifth information that represents a force of the hammer acting on the string, on the basis of a position of the hammer determined according to the performance information and on the basis of fourth information that represents a displacement at the specific point of the string, and wherein the string model calculation process inputs an excitation signal based on the fifth information as the excitation signal based on the performance information, and calculates the fourth information on the basis of the cyclic signal.

In another preferred aspect of the invention, the musical tone signal calculation process acquires sixth information that represents an impulse response of a sound pressure at an observation point in the air caused by the displacement of each vibration mode of the main body or the nth order derivative (n=1, 2, . . . ) of the displacement with time, then performs convolution of the second information calculated in the main body model calculation process and the sixth information for each vibration mode of the main body, and calculates the sound pressure at the observation point in the air as the musical tone signal by combining results of the convolution.

The present invention also provides a program executable by a computer to perform a musical tone signal synthesis of a musical tone signal based on performance information, the musical tone signal simulating a sound generated from a musical instrument having a three-dimensional structure including a string that undergoes vibration and a main body having two string supports, between which the string is stretched, the vibration traveling from the string to the main body through at least one of the string supports. The musical tone signal synthesis comprises: a string model calculation process of inputting an excitation signal based on the performance information to a closed loop having a delay element that simulates delay characteristic of the vibration propagated through the string and a characteristic control element that simulates a variation in amplitude characteristics or frequency characteristics associated to propagation of the vibration, and calculating first information representing a force of the string acting on at least one of the string supports on the basis of a cyclic signal circulating in the closed loop and representing the vibration of the string; a main body model calculation process of calculating second information representing, on modal coordinates, a displacement of each vibration mode of the main body or representing an nth order derivative (n=1, 2, . . . ) of the displacement with time, on the basis of an equation of motion that represents the vibration of the main body caused by the force of the string represented by the first information; and a musical tone signal calculation process of calculating the musical tone signal on the basis of the second information.

The present invention also provides a musical tone signal synthesis apparatus for synthesizing a musical tone signal based on performance information, the musical tone signal simulating a sound generated from a musical instrument having a three-dimensional structure including a string that undergoes vibration and a main body having two string supports, between which the string is stretched, the vibration traveling from the string to the main body through at least one of the string supports. The musical tone signal synthesis apparatus comprises: a closed loop portion having a delay element that simulates delay characteristic of vibration propagated through the string and a characteristic control element that simulates a variation in amplitude characteristics or frequency characteristics associated to propagation of the vibration; a string model calculation portion that inputs an excitation signal based on the performance information to the closed loop portion, and that calculates first information representing a force of the string acting on at least one of the string supports on the basis of a cyclic signal circulating in the closed loop and representing the vibration of the string; a main body model calculation portion that calculates second information representing, on modal coordinates, a displacement of each vibration mode of the main body or representing an nth order derivative (n=1, 2, . . . ) of the displacement with time, on the basis of an equation of motion that represents the vibration of the main body caused by the force of the string represented by the first information; and a musical tone signal calculation portion that calculates the musical tone signal on the basis of the second information.

According to the present invention, it is possible to provide a musical tone signal synthesis method, a program and a musical tone signal synthesis apparatus, capable of generating a pseudo musical instrument sound that realistically expresses characteristics of a sound generated from a three-dimensional shape musical instrument involving a string and a main body.

DETAILED DESCRIPTION OF THE INVENTION

First Embodiment

[Configuration of Electronic Musical Instrument 1]

Figure 1:
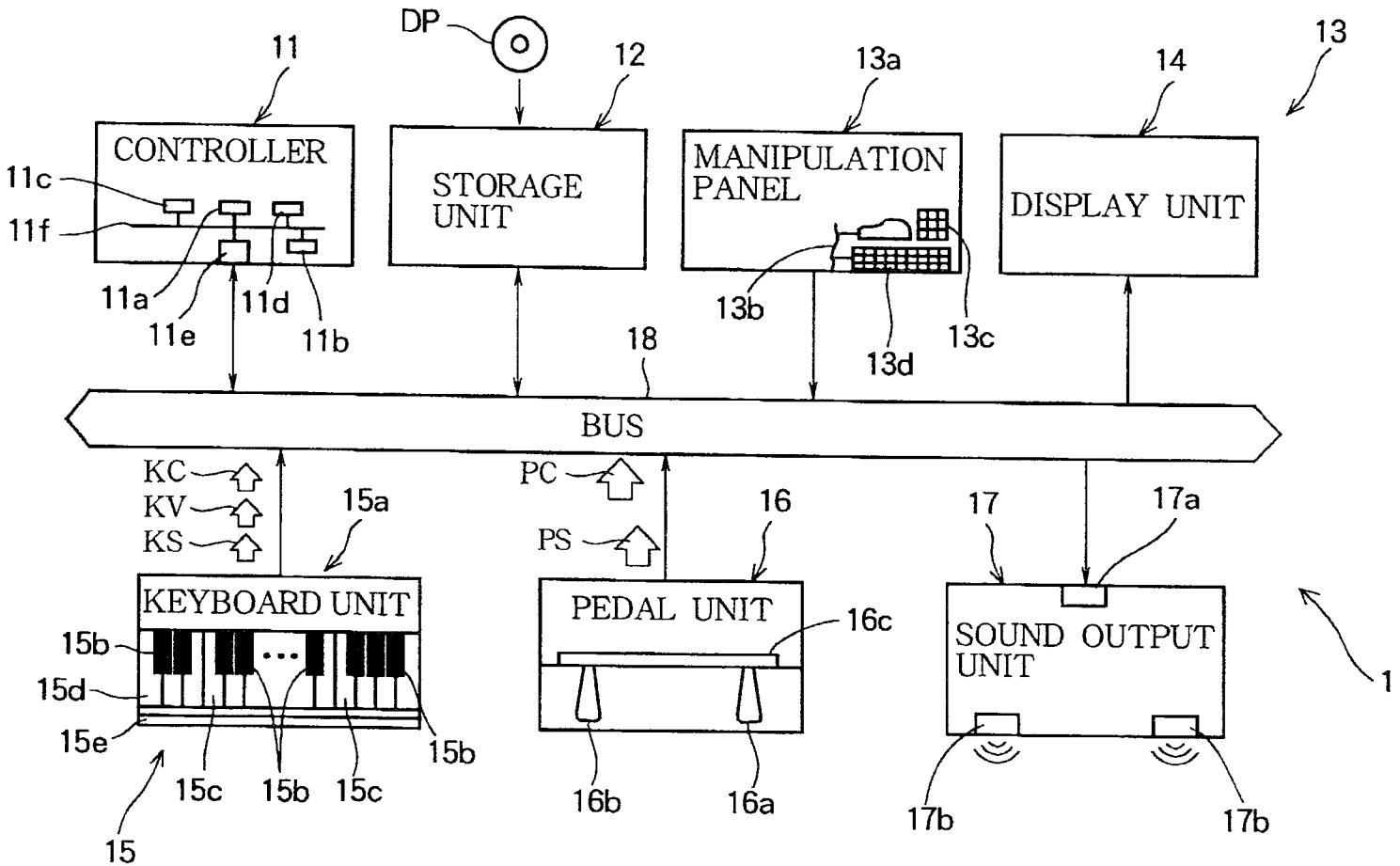
FIG. 1 is a block diagram showing a configuration of an electronic musical instrument according to a first embodiment of the invention.

FIG. 1 is a block diagram showing a configuration of an electronic musical instrument 1 according to a first embodiment of the invention. The electronic musical instrument 1 is an electronic piano, for example, and includes a controller 11, a storage unit 12, a user manipulation unit 13, a playing manipulation unit 15, and a sound output unit 17. These components are connected via a bus 18.

The controller 11 includes a Central Processing Unit (CPU) 11*a*, a Digital Signal Processor (DSP) 11*b*, other peripheral circuits (not shown), a Read Only Memory (ROM) 11*c*, a Random Access Memory (RAM) 11*d*, a signal interface 11*e*, and an internal bus 11*f*. A Direct Memory Access (DMA) controller and a video processor may be included as the other peripheral circuits. The CPU 11*a* reads a control program stored in the ROM 11*c* which is a machine readable storage medium, loads the read control program to the RAM 11*d* and executes the control program so as to control the components of the electronic musical instrument 1 via the bus 18, thereby implementing a musical tone signal synthesis unit 100 that performs a musical tone signal synthesis process, a conversion unit 110 that converts performance information into a signal input to the musical tone signal synthesis unit 100, etc., which will be described below. The RAM 11*d* functions as a work area when the CPU 11*a* processes data.

The storage unit 12 is a storage means such as a hard disk, which stores musical tone control data such as Musical Instrument Digital Interface (MIDI) data, for example, and a musical tone signal generated by musical tone signal synthesis processing which will be described below, etc. In this embodiment, the musical tone control data includes data representing variations in an intensity of key depression, a pressing intensity of a damper pedal, and a pressing intensity of a shift pedal (and a hammer velocity) with time. This data may be loaded from an information storage medium DP (for example, a compact disc) or downloaded from a server via a network and may not be necessarily stored in the storage unit 12.

Furthermore, the storage unit 12 stores waveform data representing a decorative sound. The waveform data is vibration waveform data of a deck sound generated when a key is depressed in the current embodiment. The decorative sound may be harmonics of supplementary series, a ringing sound (tinkle of a bell or metallic non-harmonic sound, such as "ding-dong", "ting-a-ling" or "ring-ring" in a range lower than about the fortieth key of a standard 88-key piano), and an action sound when the shift pedal and the damper pedal are pressed down.

In the current embodiment, the storage unit 12 stores a plurality of waveform data signals representing a deck sound generated when a specific key is depressed, which correspond to positions of respective keys. In addition, the position of each key is specified by a key number and a pressing intensity of the shift pedal. The structure of the waveform data will be described in detail later.

The user manipulation unit 13 includes a manipulation panel 13*a* and a display unit 14. The manipulation panel 13*a* includes a mouse 13*b*, a manipulation switch 13*c*, and a keyboard 13*d*, for example. When a user manipulates the mouse 13*b*, manipulation switch 13*c* and keyboard 13*d*, data that represents details of the manipulation is output to the controller 11. In this manner, the user applies an instruction to the electronic musical instrument 1. The display unit 14 is a device for displaying images on a screen, such as a liquid crystal display, and is controlled by the controller 11 to display various images such as a menu, etc. The menu may be automatically displayed on the display unit when power is supplied to the electronic musical instrument 1.

The playing manipulation unit 15 includes a keyboard unit 15*a* and a pedal unit 16. The keyboard unit 15*a* corresponds to a keyboard of an electronic piano and has a keyboard in which a plurality of keys (black keys 15*b* and white keys 15*c*) is arranged. In addition, a key position sensor 15*d* and a key velocity sensor 15*e* are provided to each of the keys 15*b* and 15*c* of the keyboard unit 15*a*. When a key is depressed, the key position sensor 15*d* outputs information that represents the intensity of the key depression and the key velocity sensor 15*e* outputs information that represents the depressing velocity of the key. The keyboard unit 15*a* outputs digital information KS converted from analog information representing the intensity of the key depression, and periodically outputs digital information KV converted from analog information representing the depressing velocity of the key to the signal interface 11*e* of the controller 11 via the bus 18. The keyboard unit 15*a* outputs the information KS and information KV with information KC (for example, key number) representing the depressed key. At this time, a hammer velocity is calculated in the controller 11 on the basis of information output from the keyboard unit 15*a*. The depressing velocity may be calculated from the intensity of the key depression, output from the key position sensor 15*d*, such that the key velocity sensor 15*e* is omitted. In this case, a calculation unit for calculating the depressing velocity from the intensity of the key depression may be provided to the keyboard unit 15*a*. Furthermore, the CPU 11*a* of the controller 11 may calculate the depressing velocity from the information KS. Information output from the keyboard unit 15*a* may include information that represents depressing acceleration.

The pedal unit 16 includes a plurality of pedals corresponding to the damper pedal 16*a* and the shift pedal 16*b*. The damper pedal 16*a* and the shift pedal 16*b* include a pedal position sensor 16*b* that outputs information representing a pressing intensity of a pedal when the pedal is pressed down. The pedal unit 16 periodically outputs digital information PS converted from analog information representing a pressing intensity of a pedal to the signal interface 11*e* of the controller 11 via the bus 18. The pedal unit 16 outputs the information PS with information PC that represents the pressed pedal. The keyboard unit 15*a* and the pedal unit 16 are manipulated in this manner so as to output the above-mentioned information (performance information).

The sound output unit 17 includes a digital-to-analog converter 17*a*, an amplifier (not shown), and a speaker 17*b*. A musical tone signal input under the control of the controller 11 is converted from a digital form into an analog form in the digital-to-analog converter 17*a*, amplified by the amplifier, and output as a sound through the speaker 17*b*. In the current embodiment, the musical tone signal is generated as a result of musical tone signal synthesis processing which will be described later. The configuration of the electronic musical instrument 1 has been explained.

[Configuration of Conversion Unit 110]

Next, the musical tone signal synthesis unit 100 and the conversion unit 110 implemented when the controller 11 executes a control program are explained with reference to FIGS. 2 and 3. Some or whole of components of the musical tone signal synthesis unit 100 and the conversion unit 110 may be implemented as hardware circuitry.

Figure 2:
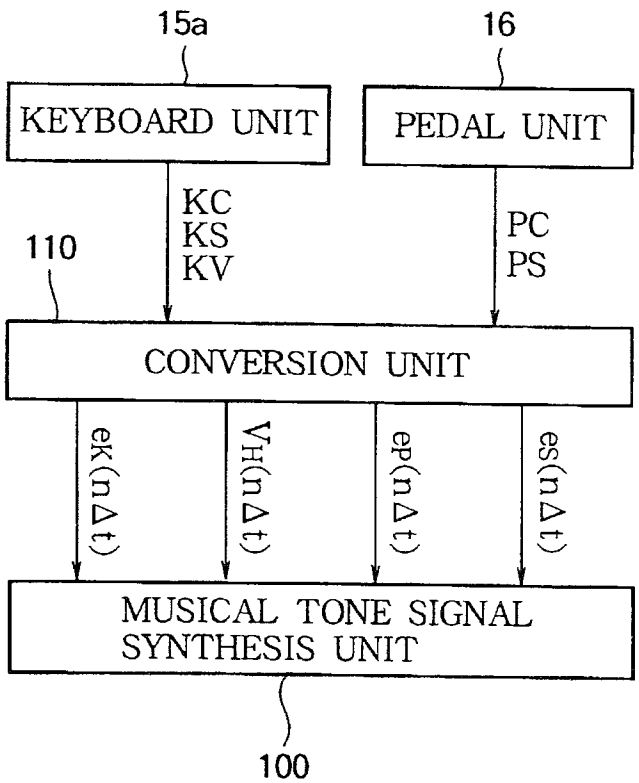
FIGS. 2(*a*) and 2(*b*) are diagrams for explaining a relationship between a conversion unit and a musical tone signal synthesis unit according to the first embodiment of the invention.
Figure 2:
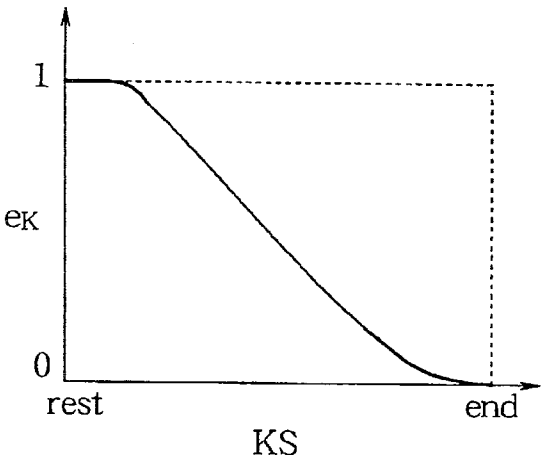

FIGS. 2(*a*) and 2(*b*) are diagrams for explaining a relationship between the conversion unit 110 and the musical tone signal synthesis unit 100. As shown in FIG. 2(*a*), the conversion unit 110 receives the performance information output from the keyboard unit 15*a* and the pedal unit 16, converts the performance information into signals used in the musical tone signal synthesis unit 100 on the basis of a previously stored conversion table, and outputs the signals. The signals output from the conversion unit 100 are input to the musical tone signal synthesis unit 100. The input signals of the musical tone signal synthesis unit 100 include a signal (hereinafter referred to as a first input signal $e_K(n\Delta t)$) generated based on the information KS and KC representing the intensity of the key depression, output from the keyboard unit 15*a*, a signal (hereinafter referred to as a second input signal $V_H(n\Delta t)$) representing the hammer velocity, which is generated based on the information KV and KC representing the depressing velocity (or depressing acceleration) of the key, a signal (hereinafter referred to as a third input signal $e_P(n\Delta t)$) generated depending on the information PS and PC representing the pressing intensity of the damper pedal, output from the pedal unit 16, and a signal (hereinafter referred to as a fourth input signal $e_S(n\Delta t)$) generated based on the information PS and PC representing the pressing intensity of the shift pedal. These four signals are input to the musical tone signal synthesis unit 100 as control signals on a discrete time base ($t=n\Delta t$; n=0, 1, 2, . . . ). In addition, these four signals may be obtained in such a manner that the controller 11 reads musical tone control data stored in the storage unit 12 and the conversion unit 110 converts the musical tone control data.

A conversion from the information KS to the first input signal $e_K(n\Delta t)$ is described as a conversion process in the conversion unit 110. FIG. 2(*b*) shows an exemplary conversion table for converting the information KS obtained by the conversion unit 100 at a specific timing to the first input signal ($e_K$ in the figure). In the current embodiment, $e_K$ is determined such that when the key is depressed from a rest position to a predetermined position, $e_K$ starts to decrease from 1 and reaches 0 at a point before an end position. This conversion table is provided for each input signal.

[Configuration of Musical Tone Signal Synthesis Unit 100]

Figure 3:
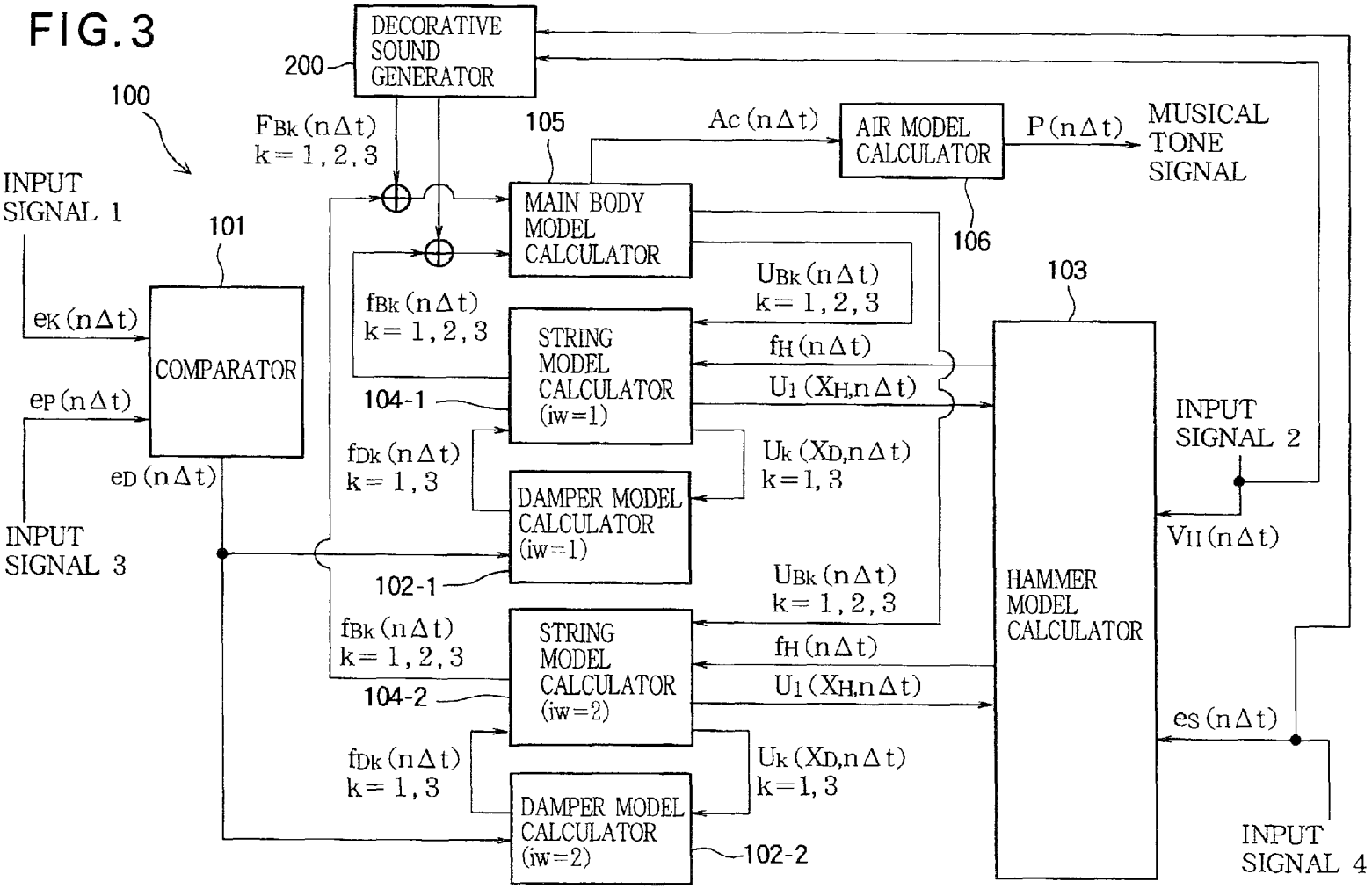
FIG. 3 is a block diagram showing a configuration of the musical tone signal synthesis unit according to the first embodiment of the invention.

FIG. 3 is a block diagram showing a configuration of the musical tone signal synthesis unit 100. The musical tone signal synthesis unit 100 synthesizes a musical tone signal that represents a pseudo piano sound according to a physical model composed of a plurality of models which will be described below (a damper model, a hammer model, a string model, a main body model, and an air model). A standard piano includes 88 keys each corresponding to one hammer, one to three strings, and zero to a plurality of dampers (which means that dampers are coupled to a string at a plurality of points). Respective Ranges have different numbers of strings and different numbers of dampers.

Figure 4:
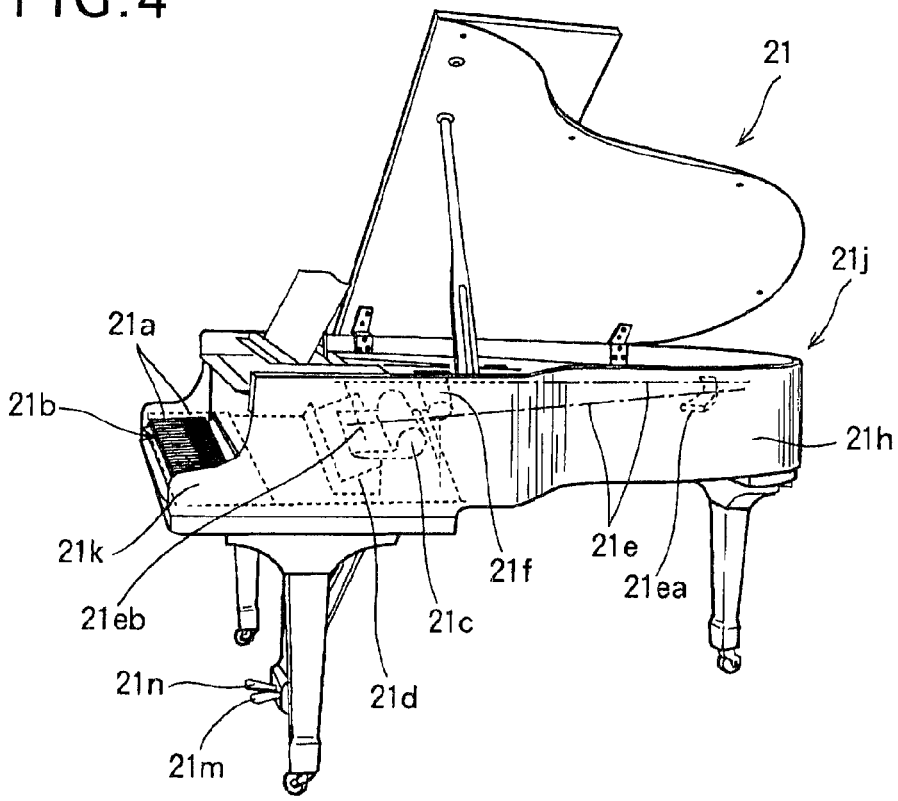
FIG. 4 shows a standard grand piano.

FIG. 4 shows a configuration of a standard grand piano 21. The above-mentioned models are based on the standard grand piano (acoustic piano) 21 shown in FIG. 4. The grand piano 21 includes a keyboard 21*b* having 88 keys 21*a*, hammers 21*c* connected to the keys 21*a* via an action mechanism 21*d*, strings 21*e*, dampers 21*f* capable of coming into contact with the strings 21*e*, a deck 21*k*, a damper pedal 21*m*, and a shift pedal 21*n*. One end of each string 21*e* is connected with a bridge 21*ea* and the other end thereof is connected with a bearing 21*eb*. Most of the keys 21*a*, hammers 21*c*, action mechanism 21*d*, strings 21*e*, dampers 21*f* and deck 21*k* are accommodated in a cabinet 21*h*. The number of the strings 21*e* and the number of contact points of the dampers 21*f* are varied depending on key ranges. The cabinet 21*h*, a frame, a wood frame, the bridge 21*ea*, the bearing 21*eb*, and a vibrating part (a sound board, a pillar, etc.) that emits a piano sound constitute a main body 21*j*. In the following description, the strings, hammers, dampers and main body represent the configuration of the standard grand piano 21 not a configuration included in the electronic musical instrument 1.

The musical tone signal synthesis unit 100 shown in FIG. 3 includes a comparator 101, damper model calculators 102-1 and 102-2 for calculating a damper model for each string corresponding thereto, a hammer model calculator 103 for calculating a hammer model, string model calculators 104-1 and 104-2 for calculating a string model for each string, a main body model calculator 105 for calculating a main body model, an air model calculator 106 for calculating an air model, and a decorative sound generator 200 that generates decorative sound information based on a decorative sound (deck sound).

The damper model calculators 102-1 and 102-2 calculate vibration of a specific string 21*e* based on the damper model. The string model calculators 104-1 and 104-2 calculate vibration of the specific string 21*e* based on the string model. The hammer model calculator 103, main body model calculator 105 and air model calculator 106 respectively calculate vibration of the specific string 21*e* based on the hammer model, the main body model and the air model.

The comparator 101 is connected to the damper model calculators 102-1 and 102-2. The damper model calculators 102-1 and 102-2 are respectively connected with the string model calculators 104-1 and 104-2. The hammer model calculator 103 is connected to both the string model calculators 104-1 and 104-2. The string model calculators 104-1 and 104-2 are connected to the main body model calculator 105. The main body model calculator 105 is connected with the air model calculator 106. The decorative sound generator 200 corrects information input to the main body model calculator 105 from the string model calculators 104-1 and 104-2. An output signal of the musical tone signal synthesis unit 100 is a musical tone signal (hereinafter, referred to as a musical tone signal P(n□t)) that represents the waveform of sound pressure at an observation point in the air, output from the air model calculator 106.

A musical tone signal obtained through musical tone synthesis processing of the musical tone signal synthesis unit 100 is based on a physical model in the case where a specific key corresponds to two strings. That is, the string model calculators 104-1 and 104-2 for calculating the string model are connected in parallel with the main body model calculator 105 for calculating the main body model. Here, if there are three strings or more, the number of the string model calculators connected to the main body model calculator 105 and the number of the damper model calculators connected to the string model calculators may be increased such that string model calculators 104-*iw* (iw=3, 4, . . . ) are connected in parallel with the main body model calculator 105 and damper model calculators 102-*iw* (iw=3, 4, . . . ) are respectively connected to the string model calculators 104-*iw*. Furthermore, if a plurality of keys is present, the number of sets of the damper model calculators 102, hammer model calculator 103 and string model calculators 104 may be increased depending on the number of keys, and the string model calculators 104 corresponding to each key may be connected to the main body model calculator 105. Accordingly, the musical tone signal synthesis unit 100 shown in FIG. 3 has generality.

The physical model of musical tone signal synthesis processing of the musical tone signal synthesis unit 100 according to this embodiment of the invention is based on the following 27 suppositions.

(Supposition 1) Gravity is ignored.

(Supposition 2) A string in a state (hereinafter, referred to as "static equilibrium") where the string immediately stops upon receiving axial force has a long thin cylindrical shape.

(Supposition 3) A string thickness is invariable. That is, needle theory is employed.

(Supposition 4) A cross section perpendicular to the central axis of the string maintains a plane and is perpendicular to the central axis even after deformation. That is, Bernoulli-Euler supposition is employed.

(Supposition 5) Though string amplitude is small, it is not micro.

(Supposition 6) The string is homogeneous.

(Supposition 7) Stress of the string is considered as the sum of a component proportional to strain and a component proportional to a strain rate. That is, internal viscous damping (stiffness proportional viscous damping) acts in the string.

(Supposition 8) One end of the string is supported at a point on a bearing corresponding to a part of the main body and the other end thereof is supported at a point on a bridge corresponding to a part of the main body (revolution of the string is not restricted at the supports).

(Supposition 9) Action and reaction between the string and the air are ignored.

(Supposition 10) A portion (hereinafter, referred to as a hammer tip) of a hammer, which comes into contact with the string, has a cylinder shape, the radius of the bottom side of the cylinder is infinitely small, and the cylinder is as high as not to interfere with another string.

(Supposition 11) When a plurality of strings corresponds to one hammer, the central axes of the strings in static equilibrium are in the same plane.

(Supposition 12) When a plurality of strings corresponds to one hammer, the hammer has hammer tips as many as the number of the strings.

(Supposition 13) The direction of the central axis of a hammer tip (cylinder) is perpendicular to the direction of the central axis (cylinder) of a string in static equilibrium.

(Supposition 14) The center of the hammer moves only on one straight line.

(Supposition 15) A motion direction of the center of the hammer is perpendicular to the direction of the central axis of the hammer tip (cylinder) and the direction of the central axis of the string (cylinder) in static equilibrium.

(Supposition 16) A direction in which the hammer is deformed corresponds to the motion direction of the center of the hammer.

(Supposition 17) A compressive force-compression amount relational expression for the hammer is considered as a Vecchi function having an exponent corresponding to a positive real number.

(Supposition 18) There is no friction between a hammer tip and the surface of a string.

(Supposition 19) Action and reaction between the hammer and the air are ignored.

(Supposition 20) For a string equipped with a damper, resistance of the damper to stop the bending vibration of the string acts on a point (hereinafter, referred to as a sound-stopping point) on the central axis of the string.

(Supposition 21) A resistance-velocity relational expression for the damper is considered to be a linear expression.

(Supposition 22) The amplitude of the main body is micro.

(Supposition 23) The main body is handled as a proportional viscous damping system approximately.

(Suppression 24) Reaction that the main body receives from the air is ignored.

(Suppression 25) The air is homogenous.

(Suppression 26) A pressure-bulk strain relational expression for the air is considered as a linear expression.

(Suppression 27) The air has no vortex.

In this embodiment, a right hand coordinate system (x, y, z) is used to represent the object position of the string. Here, the x axis corresponds to the central axis of the string in static equilibrium, the x-axis direction is determined such that the support at the bearing corresponds to the origin (0, 0, 0) and the support at the bridge is included in a region where x>0, and a motion direction when the center of the hammer is struck is determined as a positive direction of the z axis. Furthermore, a right hand coordinate system (X, Y, Z) is used to represent the object positions of the main body and the air. Lapse of time (time variable) is represented by t.

Symbols that represent parameters explained in the current embodiment will be explained.

In the following, "Lists 1 to 5" represents information that is input for calculation of each model. "List 1" corresponds to parameters (time-varying parameter) that vary with time. "Lists 2 to 5" denote parameters (time-invariant parameters) that do not vary with time and they are set in advance.

The following "List 1" represents parameters related to playing, that is, corresponds to input signals of the musical tone signal synthesis unit 100. A key, string, hammer, damper, and main body represent components 21*a*, 21*e*, 21*c*, 21*f* and 21*j* of the standard grand piano 21, respectively.

[List 1]

$V_H^{[i_K]}(t)$: Hammer velocity when the string is struck $e_K^{[i_K]}(t)$: Coefficient varied depending on an intensity of key depression $e_P(t)$: Coefficient varied depending on a pressing intensity of the damper pedal $e_S^{[i_S]}(t)$: Coefficient varied depending on a pressing intensity of the shift pedal The following "List 2" corresponds to parameters related to design.

[List 2]

$I_K$: The total number of keys $I_W^{[i_K]}$: The number of strings corresponding to one key $I_D^{[i_K][i_W]}$: The number of dampers corresponding to one string $\theta_H^{[i_K]}$: Inclination angle of a hammer moving direction with respect to a plane that is perpendicular to Z plane and includes x axis $M_H^{[i_K]}$: Mass of the hammer $K_H^{[i_K][i_W]}$: Positive constant representing elasticity of the hammer (main coefficient)

$p^{[i_K][i_W]}$: Positive constant representing elasticity of the hammer (index)

$b_D^{[i_K][i_W]}$: Viscous damping coefficient of the damper $d^{[i_K][i_W]}$: Diameter of the string $\gamma^{[i_K][i_W]}$: Density of the string in static equilibrium $E^{[i_K][i_W]}$: Longitudinal elastic modules of the string $\eta^{[i_K][i_W]}$: Internal viscous damping coefficient of the string $\alpha_H^{[i_K][i_W]}$: Constant representing the position of a point (hereinafter, referred to as "string struck point") on the string surface in contact with the hammer $\alpha_D^{[i_K][i_W][i_D]}$: Constant representing the position of the sound-stopping point $Z_B^{[i_K][i_W][i_S]}$: Z coordinate of a string support $X_B^{[i_K][i_W][i_S]}$: X coordinate of the string support $Y_B^{[i_K][i_W][i_S]}$: Y coordinate of the string support $\omega_C^{[m]}$: Natural angular frequency of the main body $\zeta_C^{[m]}$: Mode damping ratio of the main body $\phi_{B1}^{[i_K][i_W][i_S][m]}$: Z-direction component of the natural vibration mode of the main body at the string support $\phi_{B2}^{[i_K][i_W][i_S][m]}$: X-direction component of the natural vibration mode of the main body at the string support $\phi_{B3}^{[i_K][i_W][i_S][m]}$: Y-direction component of the natural vibration mode of the main body at the string support (It is considered that the natural vibration mode of the main body is normalized as mode mass)

The following "List 3" corresponds to parameters related to design of the main body and the position of the observation point in the air.

[List 3]

$\bar{h}^{[i_P][m]}(n\Delta t)$ (n=0, 1, . . . , $N^{[i_P]}-1$); Impulse response between a velocity on modal coordinates of the natural vibration mode of the main body and sound pressure at the observation point in the air.

The following "List 4" corresponds to a parameter related to tuning.

[List 4]

$\epsilon_0^{[i_K][i_W]}$: Longitudinal strain of the string in static equilibrium The following "List 5" corresponds to parameters related to numerical calculation.

[List 5]

$M_1^{[i_K]}(=M_3^{[i_K]})$: The number of natural vibration modes related to the bending vibration of the string $M_2^{[i_K]}$: The number of natural vibration modes related to the longitudinal vibration of the string M: The number of natural vibration modes of the main body Δt: Sampling time $N^{[i_P]}$: Length of the impulse response between the velocity on modal coordinates of the natural vibration mode of the main body and the sound pressure at the observation point in the air $W_H$: Value (negative real number) of $w_H^{[i_K]}(t)$ when hammer velocity $V_H^{[i_K]}(t)$ is input The following "List 6" corresponds to information output according to calculation of each model, that is, a musical tone signal.

[List 6]

$P^{[i_P]}(n\Delta t)$ (n=0, 1, . . . ): Sound pressure at the observation point in the air on the discrete time base The following "Lists 7, 8 and 9" correspond to other parameters required to calculate each model.

[List 7]

$l^{i_K i_W}$: Length of the string in static equilibrium (distance between string supports)

$x_H^{[i_K][i_W]}$: x coordinate of the string struck point $(=\alpha_H^{[i_K][i_W]} l^{[i_K][i_W]})$ $x_D^{[i_K][i_W][i_D]}$: x coordinate of a sound-stopping point $(=\alpha_D^{[i_K][i_W][i_D]} l^{[i_K][i_W]})$ $\beta_{k'k}^{[i_K][i_W]}$: Direction cosine between coordinate axes (k'=1, 2, 3; k=1, 2, 3)

| | z | x | y |
|---|---|---|---|
| Z | $\beta_{11}^{[i_K][i_W]}$ | $\beta_{12}^{[i_K][i_W]}$ | $\beta_{13}^{[i_K][i_W]}$ |
| X | $\beta_{21}^{[i_K][i_W]}$ | $\beta_{22}^{[i_K][i_W]}$ | $\beta_{23}^{[i_K][i_W]}$ |
| Y | $\beta_{31}^{[i_K][i_W]}$ | $\beta_{32}^{[i_K][i_W]}$ | $\beta_{33}^{[i_K][i_W]}$ |

Here, in the case where one string corresponds to one hammer, if $Z_B$, $X_B$, $Y_B$, and $\theta_H$ are given, $\beta_{k'k}$ is decided at a time.

[List 8]

$w_H^{[i_K]}(t)$: Displacement of the center of the hammer $w_e^{[i_K][i_W]}(t)$: Compressibility of the hammer (decrement of a distance between the tip and center of the hammer)

$f_H^{[i_K][i_W]}(t)$: Force of the hammer tip, which acts on the surface of the string $e_D^{[i_K]}(t)$: Action of the damper (quantity defined by Expression (1))

$f_{D1}^{[i_K][i_W][i_D]}(t)$: z-direction resistance of the damper $f_{D3}^{[i_K][i_W][i_D]}(t)$: y-direction resistance of the damper $u_1^{[i_K][i_W]}(x,t)$: z-direction displacement of the central axis of the string $u_2^{[i_K][i_W]}(x,t)$: x-direction displacement of the central axis of the string $u_3^{[i_K][i_E]}(x,t)$: y-direction displacement of the central axis of the string $u_{B1}^{[i_K][i_W][i_B]}(t)$: z-direction displacement of a string support $u_{B2}^{[i_K][i_W][i_B]}(t)$: x-direction displacement of the string support $u_{B3}^{[i_K][i_W][i_B]}(t)$: y-direction displacement of the string support $f_{B1}^{[i_K][i_W][i_B]}(t)$: z-direction force of the string, which acts on the string support $f_{B2}^{[i_K][i_W][i_B]}(t)$: x-direction force of the string, which acts on the string support $f_{B3}^{[i_K][i_W][i_B]}(t)$: y-direction force of the string, which acts on the string support $w_1^{[i_K][i_W][m_1]}(=w_3^{[i_K][i_W][m_1]})$: Natural angular frequency of the bending vibration of the string $w_2^{[i_K][i_W][m_2]}$: Natural angular frequency of the longitudinal vibration of the string $\zeta_1^{[i_K][i_W][m_1]}(=\zeta_3^{[i_K][i_W][m_1]})$: Mode damping ratio of the bending vibration of the string $\zeta_2^{[i_K][i_W][m_2]}$: Mode damping ratio of the longitudinal vibration of the string

[List 9]

$A_1^{[i_K][i_W][m_1]}(t)$: Displacement on the modal coordinates of the natural vibration mode, which relates to z-direction bending vibration of the string $A_2^{[i_K][i_W][m_2]}(t)$: Displacement on modal coordinates of a natural vibration mode, which relates to x-direction longitudinal vibration of the string $A_3^{[i_K][i_W][m_3]}(t)$: Displacement on modal coordinates of a natural vibration mode, which relates to y-direction bending vibration of the string $A_G^{[m]}(t)$: Displacement on modal coordinates of the natural vibration mode of the main body $p^{[i_P]}(t)$: Sound pressure at the observation point in the air $H^{[i_P][i_G]}(w)$: Frequency response function between an external normal direction component of a velocity vector at the centroid of a sound emission element (hereinafter referred to as velocity of the sound emission element) and the sound pressure at the observation point in the air $\bar{H}^{[i_P][m]}(w)$: Frequency response function between a velocity on the modal coordinates of the natural vibration mode of the main body and the sound pressure at the observation point in the air $\bar{h}^{[i_P][m]}(t)$: Impulse response function between the velocity on the modal coordinates of the natural vibration mode of the main body and the sound pressure at the observation point in the air $I_G$: The number of sound emission elements $\phi_G^{[i_C][m]}$: External normal direction component of the natural vibration mode of the main body at the centroid of the sound emission element (it is considered that the natural vibration mode of the main body is normalized as mode mass.)

The following "List 10" explains indexes written as subscript characters for the above parameters.

[List 10]

$i_K$: Key index (key number) ($i_K$=1, 2, . . . , $I_K$)

$i_W$: Index of a string corresponding to one key ($i_W$=1, 2, . . . $I_W^{[i_K]}$)

$i_S$: Index for discriminating a case ($i_S$=1) where the hammer tip and the string come into contact with each other from a case ($i_S$=2) where they do not come into contact with each other when the shift pedal is completely pressed down $i_S$=2 if $I_W \geqq 3$ and $i_W = I_W$, $i_S$=1 otherwise $i_D$: Index of a damper corresponding to one string ($i_D$=1, 2, . . . , $I_D^{[i_K][i_W]}$)

$i_B$: Index of a string support ($i_B$=0, 1) which represents the string support on the bridge when $i_B$=0 and represents the string support on the bearing when $i_B$=1

$i_G$: Index of the sound emission element ($i_G$=1, 2, . . . , $I_G$)

$i_P$: Index of the observation point in the air ($i_P$=1, 2, . . . , $I_P$)

$m_1$,$i_1$: Index of the natural vibration mode related to the bending vibration of the string ($m_1$=1, 2, . . . , $M_1^{[i_K]}$)

$m_2$,$i_2$: Index of the natural vibration mode related to the longitudinal vibration of the string ($m_2$=1, 2, . . . , $M_2^{[i_K]}$)

$m_3$,$i_3$: Index of the natural vibration mode related to the bending vibration of the string ($m_3$=1, 2, . . . , $M_3^{[i_K]}$)

m: Index of the natural vibration mode of the main body (m=1, 2, . . . , M))

Processing of each component of the musical tone synthesis unit 100 according to the current embodiment will be explained with reference to FIG. 2. In the following description, since expressions become complicated when every index is written, indexes are omitted except inevitable cases in terms of explanation.

"1" is set as an initial value (value when t=0) to variables $e_K(t)$, $e_P(t)$ and $e_S(t)$. That is, a state in which a key (black key 15*b* or white key 15*c*), the damper pedal 16*a* and the shift pedal 16*b* are not pressed down is set. "0" is set as an initial value to other variables related to "t".

The comparator 101 receives the first input signal $e_K(n\Delta t)$ and the third input signal $e_P(n\Delta t)$ and outputs a smaller one as $e_D(n\Delta t)$. This is represented by the following Equation (1).

$$e_D(t)=\min(e_K(t),e_P(t)) \tag{1}$$

$e_K(t)$=1: State in which a key is not completely depressed $1 \geqq e_K(t) \geqq 0$: State in which the key is depressed to a partway position $e_K(t)$=0: State in which the key is completely depressed $e_P(t)$=1: State in which the damper pedal is not pressed down $1 \geqq e_P(t) \geqq 0$: State in which the damper pedal is pressed down to a partway portion $e_P(t)$=0: State in which the damper pedal is completely pressed down

[Damper Model]

The damper model calculator 102 includes the damper model calculator 102-1 that performs calculation on a damper corresponding to a first string (iw=1) and the damper model calculator 102-2 that performs calculation on a damper corresponding to a second string (iw=2). In the following description, the damper model calculators 102-1 and 102-2 are explained as a damper model calculator 102 since they only have different string indexes. In the case where three strings or more are present, damper model calculators 102-*iw* (iw=3, 4, . . . ) corresponding to strings (iw=3, 4, . . . ) are provided, as described above.

The string model calculator 104 includes the string model calculator 104-1 that performs calculation on the first string (iw=1) and the string model calculator 104-2 that performs calculation on the second string (iw=2). In the following description, the string model calculators 104-1 and 104-2 are explained as a string model calculator 104 since they only have different string indexes. In the case where three strings or more are present, string model calculators 104-*iw* (iw=3, 4, . . . ) may be arranged in parallel with the main body model calculator 105, as described above (calculation of the string model calculator 104 will be explained below).

The damper model calculator 102 reads $e_D(n\Delta t)$ output from the comparator 101 and $u_K(x_D,n\Delta t)$ (k=1, 3) output from the string model calculator 104, which will be described below, and outputs $f_{Dk}(n\Delta t)$ obtained from the following calculation performed using the read signals to the string model calculator 104.

Calculations in the damper model calculator 102 will now be explained.

Vibration of piano strings in an initial state is suppressed by the dampers. When a piano key is pressed, a damper corresponding to the key is gradually separated from a corresponding string, and the string is completely released from the resistance of the damper eventually to prepare to be struck by a corresponding hammer. Furthermore, in the piano, it is possible to change a degree by which the damper and string come into contact with each other depending on a pressing intensity of the damper pedal as well as an intensity of key depression and to accurately control a sound-blocking form or a degree of string resonance.

A damper mechanism in the above-described piano can be simply represented using the following relational expression (2) for a relationship between damper resistance $f_{Dk}(t)$ and damper deformation $u_K(x_D,t)$.

$$f_{Dk}^{[i_D]}(t) = b_D e_D(t) \frac{d}{dt} u_k\left(x_D^{[i_D]}, t\right) \tag{2}$$

$$k = 1, 3$$

In the current embodiment, it is possible to control natural continuous sound stop and string resonance corresponding to those of the piano that is a natural musical instrument according to an idea of sequentially changing a quantity "$b_{DeD}(n\Delta t)$" corresponding to the elastic coefficient of the damper on the discrete time base (t=nΔt; n=0, 1, 2, . . . ) by applying $e_D(n\Delta t)$ output from the comparator 101 to Expression (2).

[Hammer Model]

The hammer model calculator 103 receives the second input signal $V_H(n\Delta t)$ and the fourth input signal $e_S(n\Delta t)$, accepts $u_1(x_H,n\Delta t)$ output from the string model calculator 104 as described below, and outputs $f_H(n\Delta t)$ obtained from the following calculation to the string model calculator 104 using the received signals.

Calculations in the hammer model calculator 103 will now be described.

When Newton's law of motion is applied to the above-mentioned physical model related suppositions, the equation of motion of the hammer is represented as Equation (3).

$$\frac{d^2}{dt^2} w_H(t) = -\frac{1}{M_H} \sum_{i_W=1}^{I_W} f_H^{[i_W]}(t) \tag{3}$$

A relationship between the force of the hammer tip acting on the surface of the string and compressibility of the hammer is represented by the Equation (4).

$$f_H^{[iW]}(t)=K_H e_S^{[iS]}(t)\{w_E^{[iW]}(t)\}^P \tag{4}$$

$e_S^{[iS]}(t)$=1: State in which the shift pedal is not pressed down $1 \geqq e_S^{[1]}(t) > 0$: State in which the shift pedal is pressed down to a partway position $1 > e_S^{[1]}(t) > 0$: State in which the shift pedal is completely pressed down $1 \geqq e_S^{[2]}(t) > 0$: State in which the shift pedal is pressed down to a partway position $e_S^{[2]}(t) = 0$: State in which the shift pedal is completely pressed down Equation (5) is applied when the hammer tip is in contact with the string surface and Equations (6) and (7) are applied when the hammer tip is separated from the string surface.

$$w_e(t) = w_H(t) - u_1(x_H, t) \geqq 0 \tag{5}$$

$$w_e(t) = 0 \tag{6}$$

$$w_H(t) - u_1(x_H, t) < 0 \tag{7}$$

When the hammer velocity $V_H(t)$ is given based on the performance information, it is preferable to initialize the state of the hammer according to $w_H(t) = w_H$ and $dw_H(t)/dt = V_H(t)$ under the condition that the hammer tip is separated from the string surface.

While a shift pedal mechanism in the piano shifts the position of the hammer to a high pitch range when the shift pedal is pressed down, and controls a tone color by changing a hammer portion in contact with the string, or by making contact of the hammer and some strings incomplete, it is possible to achieve natural and continuous tone color control corresponding to that of the piano that is a natural musical instrument according to an idea of sequentially changing a quantity $K_{He_S^{[S]}}(n\Delta t)$ corresponding to the elastic coefficient of the hammer on the discrete time base ($t = n\Delta t$; $n = 0, 1, 2, \ldots$) by applying the fourth input signal $e_S^{[tS]}(n\Delta t)$ to Equation (4). The hammer model calculator 102 has been explained.

[String Model]

The string model calculator 104 receives $f_{Dk}(n\Delta t)$ ($k = 1, 3$) output from the damper model calculator 102, and $f_H(n\Delta t)$ output from the hammer model calculator 103, which correspond to force acting on the string, and $u_{Bk}(n\Delta t)$ ($k = 1, 2, 3$) output from the body model calculator 105 as described below, outputs $f_{Bk}(n\Delta t)$ ($k = 1, 2, 3$) obtained from the following calculation to the main body model calculator 105 using the received signals, outputs $u_k(x_D, n\Delta t)$ ($k = 1, 3$) to the damper model calculator 102, and outputs $u_1(x_H, n\Delta t)$ to the hammer model calculator 103.

Calculations in the string model calculator 104 will now be explained.

When Newton's law of motion is applied to the above-mentioned physical model related suppositions, the equation of motion of the string is represented as Equations (8), (9) and (10).

$$\left\{\left(1 - c_5^2\frac{\partial^2}{\partial x^2}\right)\frac{\partial^2}{\partial t^2} - c_1^2\left(1 + \eta\frac{\partial}{\partial t}\right)\frac{\partial^2}{\partial x^2} + c_4^2\left(1 + \eta\frac{\partial}{\partial t}\right)\frac{\partial^4}{\partial x^4}\right\}u_1(x, t) = \frac{1}{\rho}f_H(t)\delta(x - x_H) - \frac{1}{\rho}\sum_{i_D=1}^{I_D} f_{D1}^{[i_D]}(t)\delta(x - x_D^{[i_D]}) \tag{8}$$

$$\left\{\frac{\partial^2}{\partial t^2} - c_2^2\left(1 + \eta\frac{\partial}{\partial t}\right)\frac{\partial^2}{\partial x^2}\right\}u_2(x, t) = \frac{1}{2}c_3^2\left(1 + \eta\frac{\partial}{\partial x}\right)\frac{\partial}{\partial x}\left\{\left(\frac{\partial}{\partial x}u_3(x, t)\right)^2 + \left(\frac{\partial}{\partial x}u_1(x, t)\right)^2\right\} \tag{9}$$

-continued $$\left\{\left(1 - c_5^2\frac{\partial^2}{\partial x^2}\right)\frac{\partial^2}{\partial t^2} - c_1^2\left(1 + \eta\frac{\partial}{\partial t}\right)\frac{\partial^2}{\partial x^2} + c_4^2\left(1 + \eta\frac{\partial}{\partial t}\right)\frac{\partial^4}{\partial x^4}\right\}u_3(x, t) = -\frac{1}{\rho}\sum_{i_D=1}^{I_D} f_{D3}^{[i_D]}(t)\delta(x - x_D^{[i_D]}) \tag{10}$$

Here, $$\rho = \gamma S,\ c_1^2 = \frac{E}{\gamma}\varepsilon_0,\ c_2^2 = \frac{E}{\gamma},$$
$$c_3^2 = \frac{E}{\gamma}(1 - \varepsilon_0),\ c_4^2 = \frac{EI}{\gamma S},\ c_5^2 = \frac{I}{S},$$
$$S = \frac{\pi}{4}d^2,\ I = \frac{\pi}{64}d^4,$$

and $\delta$ represents $\delta$ function of Dirac.

In Equations (8) and (10), nonlinear terms caused by finite amplitude are omitted since their effects are insignificant. Similarly, in Equation (9), force applied by the hammer in string axial direction is omitted since its effect is insignificant. Equation (8) corresponds to the bending vibration of the string corresponding to the moving direction of the center of the hammer, Equation (10) corresponds to the bending vibration of the string corresponding to a direction perpendicular to the moving direction of the center of the hammer, and Equation (9) corresponding to the longitudinal vibration of the string.

The boundary condition of the string is represented by Equations (11) and (12).

$$\left.\begin{aligned} u_k(0, t) &= u_{Bk}^{[i_B]}(t)\big|_{i_B=1} \quad k = 1, 2, 3 \\ \frac{\partial^2}{\partial x^2}u_k(0, t) &= 0 \quad k = 1, 3 \end{aligned}\right\} \tag{11}$$

$$\left.\begin{aligned} u_k(l, t) &= u_{Bk}^{[i_B]}(t)\big|_{i_B=0} \quad k = 1, 2, 3 \\ \frac{\partial^2}{\partial x^2}u_k(l, t) &= 0 \quad k = 1, 3 \end{aligned}\right\} \tag{12}$$

Now, "displacement of the string" is represented by a sum of "relative displacement with respect to a straight line connecting two string supports" and "displacement of the straight line connecting the two supports", and the "relative displacement with respect to the straight line connecting the two supports" is represented by "finite Fourier sine series having an arbitrary time function as a coefficient". That is, "displacement of the string" is represented by Equation (13). Here, a sine function included in Equation (13) corresponds to the natural vibration mode of the string when displacement of the central axis of the string with respect to a string support has been restricted. In addition, "displacement of the straight line connecting the two supports" means "static displacement of the string according to displacement of the string supports".

$$u_k(x, t) = \sum_{m_k=1}^{M_k} A_k^{[m_k]}(t)\sin\frac{m_k\pi x}{l} + \frac{x}{l}u_{Bk}^{[i_B]}(t)\bigg|_{i_B=0} + \frac{l - x}{l}u_{Bk}^{[i_B]}(t)\bigg|_{i_B=1} \quad k = 1, 2, 3 \tag{13}$$

At this time, Equation (13) satisfies boundary condition expressions (11) and (12) at arbitrary time t.

When Equation (13) is applied to the partial differential equations (8), (9) and (10), and then Equations (8), (9) and (10) are multiplied by $\sin(i_k\pi x/l)$ ($i_k = 1, 2, \ldots, M_k$; $k = 1, 2, 3$)

and integration is performed in a section $0 \leqq x \leqq 1$, the following two-order ordinary differential equations (Equations (14), (15) and (16)) are derived.

$$\left\{\frac{d^2}{dt^2} + 2\zeta_1^{[i_1]} w_1^{[i_1]} \frac{d}{dt} + (w_1^{[i_1]})^2\right\} A_1^{[i_1]}(t) = \frac{d^2}{dt^2}\left\{\sum_{i_B=0}^{1} v_{B1}^{[i_B][i_1]} u_{B1}^{[i_B]}(t)\right\} + v_H^{[i_1]} f_H(t) - \sum_{i_D=1}^{I_D} v_{D1}^{[i_D][i_1]} f_{D1}^{[i_D]}(t) \tag{14}$$

$$i_1 = 1, 2, \ldots, M_1$$

$$\left\{\frac{d^2}{dt^2} + 2\zeta_2^{[i_2]} w_2^{[i_2]} \frac{d}{dt} + (w_2^{[i_2]})^2\right\} A_2^{[i_2]}(t) = \frac{d^2}{dt^2}\left\{\sum_{i_B=0}^{1} v_{B2}^{[i_B][i_2]} u_{B2}^{[i_B]}(t)\right\} - c_3^2 \frac{1}{l}\left(\frac{\pi}{l}\right)^3 i_2\left(1 + \eta\frac{d}{dt}\right)\left\{\sum_{m_3=1}^{M_3}\sum_{m_3'=1}^{M_3} m_3 m_3' \Gamma_{m_3 m_3' i_2} A_3^{[m_3]}(t) A_3^{[m_3']}(t) + \sum_{m_1=1}^{M_1}\sum_{m_1'=1}^{M_1} m_1 m_1' \Gamma_{m_1 m_1' i_2} A_1^{[m_1]}(t) A_1^{[m_1']}(t)\right\} \tag{15}$$

$$i_2 = 1, 2, \ldots, M_2$$

$$\left\{\frac{d^2}{dt^2} + 2\zeta_3^{[i_3]} w_3^{[i_3]} \frac{d}{dt} + (w_3^{[i_3]})^2\right\} A_3^{[i_3]}(t) = \frac{d^2}{dt^2}\left\{\sum_{i_B=0}^{1} v_{B3}^{[i_B][i_3]} u_{B3}^{[i_B]}(t)\right\} - \sum_{i_D=1}^{I_D} v_{D3}^{[i_D][i_3]} f_{D3}^{[i_D]}(t) \tag{16}$$

$$i_3 = 1, 2, \ldots, M_3$$

Here $$w_k^{[i_k]} = \frac{i_k \pi c_1}{l}\sqrt{\left\{1 + \left(\frac{c_4}{c_1}\right)^2\left(\frac{i_k\pi}{l}\right)^2\right\} \Big/ \left\{1 + c_5^2\left(\frac{i_k\pi}{l}\right)^2\right\}} \tag{17}$$

$$k = 1, 3$$

$$w_2^{[i_2]} = \frac{i_2 \pi c_2}{l} \tag{18}$$

$$\zeta_k^{[i_k]} = \eta w_k^{[i_k]}/2 \tag{19}$$

$$k = 1, 2, 3$$

$$v_{Bk}^{[i_B][i_k]} = \frac{2}{i_k\pi}(-1)^{(1-i_B)i_k + i_B} \Big/ \left\{1 + c_5^2\left(\frac{i_k\pi}{l}\right)^2\right\} \tag{20}$$

$$k = 1, 3$$

$$v_{B2}^{[i_B][i_2]} = \frac{1}{i_2\pi}(-1)^{(1-i_B)i_2 + i_B} \tag{21}$$

$$v_H^{[i_1]} = 2\sin(i_1\pi\alpha_H) \Big/ \left[\rho l\left\{1 + c_5^2\left(\frac{i_1\pi}{l}\right)^2\right\}\right] \tag{22}$$

$$v_{Dk}^{[i_D][i_k]} = 2\sin\left(i_k\pi\alpha_D^{[i_D]}\right) \Big/ \left[\rho l\left\{1 + c_5^2\left(\frac{i_k\pi}{l}\right)^2\right\}\right] \tag{23}$$

$$k = 1, 3$$

$$\Gamma_{m_k m_k' i_2} = \int_0^l \cos\frac{m_k\pi x}{l}\cos\frac{m_k'\pi x}{l}\cos\frac{i_2\pi x}{l}\,dx \tag{24}$$

$$k = 1, 3$$

A relational expression with respect to a relationship between the force of the string acting on a string support and support displacement is represented by Equations (25) and (26).

$$f_{Bk}^{[i_B]}(t) = (-1)^{i_B}\left[-c_1'\left(1 + \eta\frac{d}{dt}\right)\frac{\partial}{\partial x}u_k((1 - i_B)l, t) + c_4'\left(1 + \eta\frac{d}{dt}\right)\frac{\partial^3}{\partial x^3}u_k((1 - i_B)l, t)\right] \tag{25}$$

$$i_B = 0, 1;\ k = 1, 3$$

$$f_{B2}^{[i_B]}(t) = (-1)^{i_B}\left[-c_2'\left(1 + \eta\frac{d}{dt}\right)\frac{\partial}{\partial x}u_2((i - i_B)l, t)\right] \tag{26}$$

$$i_B = 0, 1$$

where $$c'_1 = ES\epsilon_0, c'_2 = ES, c'_4 = EI \tag{27}$$

Furthermore, Equations (28) and (29) are derived by applying Equation (13) to Equations (25) and (26). Here, nonlinear terms and terms related to rotational inertia are omitted.

$$f_{Bk}^{[i_B]}(t) = (-1)^{i_B}\left[-c_1'\left(1 + \eta\frac{d}{dt}\right)\left\{\sum_{m_k=1}^{M_k} A_k^{[m_k]}(t)\left(\frac{m_k\pi}{l}\right)(-1)^{(1-i_s)m_k} + \frac{1}{l}\sum_{i_B'=0}^{1}(-1)^{i_B'} u_{Bk}^{[i_B']}(t)\right\} - c_4'\left(1 + \eta\frac{d}{dt}\right)\left\{\sum_{m_k=1}^{M_k} A_k^{[m_k]}(t)\left(\frac{m_k\pi}{l}\right)^3(-1)^{(1-i_B)m_k}\right\}\right] \tag{28}$$

$$i_B = 0, 1;\ k = 1, 3$$

$$f_{B2}^{[i_B]}(t) = (-1)^{i_B}\left[-c_2'\left(1 + \eta\frac{d}{dt}\right)\left\{\sum_{m_2=1}^{M_2} A_2^{[m_2]}(t)\left(\frac{m_2\pi}{l}\right)(-1)^{(1-i_B)m_2} + \frac{1}{l}\sum_{i_B'=0}^{1}(-1)^{i_B'} u_{B2}^{[i_B']}(t)\right\}\right] \tag{29}$$

$$i_B = 0, 1;$$

Displacements of the string struck point and sound stop point are represented as Equations (30) and (31) according to Equation (13).

$$u_1(x_H, t) = \sum_{m_1=1}^{M_1} A_1^{[m_1]}(t)\sin(m_1\pi\alpha_H) + \alpha_H u_{B1}^{[i_B]}(t)\Big|_{i_B=0} + (1 - \alpha_H)u_{B1}^{[i_B]}(t)\Big|_{i_B=1} \tag{30}$$

$$u_k\left(x_D^{[i_D]}, t\right) = \sum_{m_k=1}^{M_k} A_1^{[m_k]}(t)\sin\left(m_k\pi\alpha_D^{[i_D]}\right) + \alpha_D^{[i_D]} u_{Bk}^{[i_B]}(t)\Big|_{i_B=0} + \left(1 - \alpha_D^{[i_D]}\right)u_{Bk}^{[i_B]}(t)\Big|_{i_B=1} \tag{31}$$

$$k = 1, 3$$

The string model calculator 104 has been explained.

[Configuration of Decorative Sound Generator 200]

The decorative sound generator 200 receives the second input signal $V_H(n\Delta t)$ and the fourth input signal $e_S(n\Delta t)$ and generates decorative sound information that represents force $F_{Bk}(n\Delta t)$ (k=1, 2, 3) acting on a string support by a decorative sound. In addition, the decorative sound generator 200 corrects $f_{Bk}(n\Delta t)$ that is output from the string model calculator 104 and input to the main body model calculator 105 based on $F_{Bk}(n\Delta t)$. In this embodiment, the decorative sound generator 200 corrects $f_{Bk}(n\Delta t)$ by outputting $F_{Bk}(n\Delta t)$ and adding it to $f_{Bk}(n\Delta t)$. $F_{Bk}(n\Delta t)$ has indexes $i_K$, $i_W$, and $i_B$ as does $f_{Bk}(n\Delta t)$. It is possible to perform addition only for k=1 by setting $F_{Bk}(n\Delta t)$ to 0 when k=2, 3 to 0. Furthermore, the decorative sound generator 200 may correct $f_{Bk}(n\Delta t)$ not only by simply adding $F_{Bk}(n\Delta t)$ to $f_{Bk}(n\Delta t)$ but also by a combination of subtraction, weighting and addition, integration, division, etc.

Figure 5:
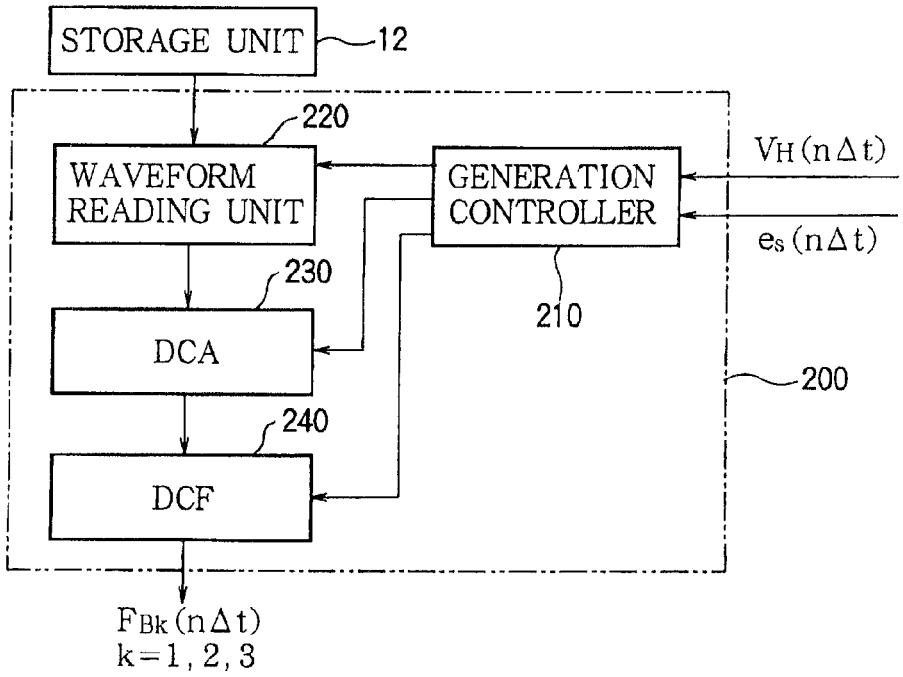
FIG. 5 is a block diagram showing a configuration of a decorative sound generator according to the first embodiment of the invention.

FIG. 5 is a block diagram showing a configuration of the decorative sound generator 200. The decorative sound generator 200 includes a generation controller 210, a waveform reading unit 220, a Digital Controlled Amplifier (DCA) 230, and a Digital Controlled Filter (DCF) 240. The generation controller 210 receives the second input signal $V_H(n\Delta t)$ and the fourth input signal $e_S(n\Delta t)$ and controls the waveform reading unit 220, DAC 230 and DCF 240 based on the received signals. In addition, the decorative sound generator 200 may receive the performance information instead of the input signals.

The waveform reading unit 220 reads waveform data selected under the control of the generation controller 210 from waveform data stored in the storage unit 12 and outputs the read waveform data. Here, the waveform data stored in the storage unit 12 is explained.

The waveform data stored in the storage unit 12 represents a vibration waveform of a deck sound generated when a specific key 21*a* of the standard grand piano 21 is depressed as described above. Specifically, the waveform data is generated as described below, for example.

In the state that the corresponding string 21*e* is not vibrated when the key 21*a* is depressed, the user detects displacements at the string supports (the bridge 21*ea* and the bearing 21*eb*) to which vibration of the deck sound generated by depressing the specific key 21*a* is propagated for all the strings 21*e* using a displacement sensor. The state that the string 21*e* is not vibrated (does not generate a sound) may be a state that the string 21*e* is separated, a state that the hammer 21*c* is separated, or a state that the string 21*e* is damped.

Detection initiation timing may be determined as a timing included in a period from when the key 21*a* starts to be depressed to when the deck sound is generated.

The force $F_{Bk}(n\Delta t)$ applied to the string supports on the discrete time base (t=n□t; n=0, 1, 2, . . . ) is calculated from the detected displacements. $F_{Bk}(n\Delta t)$ corresponds to waveform data in the case where the specific key 21*a* is depressed at a specific velocity.

Waveform data corresponding to $F_{Bk}(n\Delta t)$ calculated as above is matched to each key 21*a* and stored in the storage unit 12. In addition, since a collision point of the key 21*a* and the deck 21*k* is varied even with the pressing intensity of the shift pedal 21*n*, the waveform data depending on the pressing intensity is stored in the storage unit 12 even in the case where the pressing intensity of the shift pedal 21*n* is varied as well as in the case where the pressing intensity of the shift pedal 21*n* is zero. That is, the storage unit 12 stores the waveform data on the basis of a combination of the key number of each key 21*a* (corresponding to the information KC of the performance information) and the pressing intensity of the shift pedal 21*n* (corresponding to the information PS of the performance information).

The waveform reading unit 220 reads waveform data corresponding to a combination of the number of the key 21*a*, which corresponds to the index $i_K$ of $V_H(n\Delta t)$ acquired by the generation controller 210, and the pressing intensity of the shift pedal 21*n*, which corresponds to $e_S(n\Delta t)$, and outputs the waveform data to the DCA 230 under the control of the generation controller 210. It is desirable to determine a timing at which the waveform reading unit 220 reads the waveform data on the basis of a variation in the value $V_H(n\Delta t)$, for example, and to control a deck sound to be generated in a sound represented by the musical tone signal P(n□t) at a timing at which the keys 15*b* and 15*c* are considered to be manipulated and collided with the deck 21*k*.

The DCA 230 amplifies the waveform data with an amplification factor depending on $V_H(n\Delta t)$ acquired by the generation controller 210 under the control of the generation controller 210. The amplification factor is controlled such that it increases as a hammer velocity corresponding to $V_H(n\Delta t)$ increases in the current embodiment.

The DCF 240 is a low pass filter that attenuates a high-frequency component of the waveform data, and a cutoff frequency corresponding to $V_H(n\Delta t)$ acquired by the generation controller 210 is set. This cutoff frequency is controlled such that it increases as the hammer velocity corresponding to $V_H(n\Delta t)$ increases in the current embodiment. The decorative sound generator 200 outputs the waveform data processed in the DCA 230 and the DCF 240 as $F_{Bk}(n\Delta t)$.

$F_{Bk}(n\Delta t)$ output in this manner is added to $f_{Bk}(n\Delta t)$ output from the string model calculator 104, and thus the force acting on the string supports includes not only the force caused by vibration of string but also the force caused by vibration of the deck sound.

The decorative sound generator 200 has been explained.

[Main Body Model]

The main body model calculator 105 receives $f_{Bk}(n\Delta t)$ that is output from the string model calculator 104 and corrected by the decorative sound generator 200, outputs $A_C(n\Delta t)$ obtained from the following calculation to the air model calculator 106 using $f_{Bk}(n\Delta t)$, and outputs $u_{Bk}(n\Delta t)$ (k=1, 2, 3) to the string model calculator 104. In the description of the air model calculator 106, the input signal $f_{Bk}(n\Delta t)$ corresponds to the value (force of the string and the decorative sound acting on the string supports) corrected by the decorative sound generator 200, instead of the value output from the string model calculator 104.

Calculations in the main body model calculator 105 will now be explained.

The equation of motion of the main body can be represented as the following two-order ordinary differential equation (Equation (32)) for each mode according to the above-mentioned physical model related suppositions.

$$\left\{\frac{d^2}{dt^2} + 2\zeta_C^{[m]} w_C^{[m]} \frac{d}{dt} + (w_C^{[m]})^2\right\} A_C^{[m]}(t) = \sum_{i_K=1}^{I_K} \sum_{i_W=1}^{I_W^{[i_K]}} \sum_{i_B=0}^{1} \sum_{k=1}^{3} f_{Bk}^{[i_K][i_W][i_B]}(t) \hat{\phi}_{Bk}^{[i_K][i_W][i_B][m]} \tag{32}$$

$m = 1, 2, \ldots, M$ where $$\hat{\phi}_{Bk}^{[i_K][i_W][i_B][m]} = \sum_{k'=1}^{3} \beta_{k'k}^{[i_K][i_W]} \phi_{Bk}^{[i_K][i_W][i_B][m]} \tag{33}$$

Meanwhile, the piano body is made of wood, metal, etc. Among these materials, the wood has characteristic that vibration damping capacity of a high-frequency component is higher than that of a low-frequency component, and this characteristic causes characteristic "melodious and warm sound" of the piano (or a musical instrument having a main body made of wood). This acoustic property of wood makes it possible to model the wood as a "material having three-dimensional perpendicular anisotropy for both elasticity coefficient and structure damping coefficient" (for example, Patent Reference 1: Advanced Composite Materials, published by The Japan Society of Mechanical Engineers, pp. 68-70, Gihoodo Books, 1990).

It is impossible to diagonalize a damping matrix according to real eigenvalue analysis because the main body model configured such that it includes the "material having three-dimensional perpendicular anisotropy for both elasticity coefficient and structure damping coefficient" becomes a normal structural damping system (also referred to as nonclassically damped structural system or normal hysteretic damping system) (Patent Reference 2). However, the main body model is considered as a classically damped structural system (refereed to as a proportional hysteretic damping system) approximately by ignoring an off-diagonal term of the damping matrix (Patent Reference 2: Nagamatsu Akio, Mode Analysis, published by Baihukan. 1985).

The classically damped structural system is approximated as a proportional viscous damping system, that is, a mode damping ratio is represented as "mode structural damping coefficient/2". At this time, it is possible to calculate the natural angular frequency, mode damping ratio, and natural vibration mode included in Equation (32) by performing real eigenvalue analysis using commercial finite element method software for the main body in an arbitrary three-dimensional shape. Though the mode damping ratio can be an approximate mode damping ratio, the mode damping ratio is a simply mode damping ratio in the current embodiment for convenience.

Displacement of a string support can be calculated using the following Equation (34).

$$u_{Bk}^{[i_B]}(t) = \sum_{m=1}^{M} A_C^{[m]}(t)\hat{\phi}_{Bk}^{[i_B][m]} \quad (34)$$

$$i_B = 0, 1; k = 1, 2, 3$$

The main body model calculator 105 has been explained.

[Solving Equation of Motion]

Exemplary methods for solving the equations of motion with respect to the above-mentioned models are explained. In the following explanation, the equation of motion of the hammer (Equation (3)), the equation of motion of the string for each mode (Equations (14), (15) and (16)), and the equation of motion of the main body for each mode (Equation (32)) are combined and referred to as "equation of motion of hammer-string-body". When variables $f_{Dk}^{[i_D]}(t)$, $f_H^{[i_W]}(t)$, $w_e(t)$, $f_{Bk}^{[i_B]}(t)$, $u_1(x_H,t)$, $u_k(x_D^{[i_D]},t)$, and $u_{Bk}^{[i_B]}(t)$ that represent interactions of partial structures are erased by substituting the above-mentioned equations of motion with Equations (2), (4), (5), (6), (28), (29), (30), (31) and (34), the "equation of motion of hammer-string-body" becomes a simultaneous nonlinear ordinary differential equation with respect to displacement $w_H(t)$ of the center of the hammer, displacement $A_k^{[m_k]}(t)$ ($m_k$=1, 2, . . . , $M_k$; k=1, 2, 3) on modal coordinates of each natural vibration mode of the string, and displacement $A_C^{[m]}(t)$ (m=1, 2, . . . , M) on modal coordinates of each natural vibration mode of the main body. Now, a problem handled in this embodiment may be considered as so-called "initial value problem of the simultaneous nonlinear ordinary differential equation" by setting a state before playing, that is, a stationary state as an initial condition. The "initial value problem of the simultaneous nonlinear ordinary differential equation" can be changed to a problem of sequentially solving the simultaneous nonlinear algebraic equation on the discrete time base by using some numerical integration methods (Patent Reference 3).

(Non-patent Reference 3: Basics and Applications of numerical integration, published by The Japan Society of Mechanical Engineers, Corona company, 2003)

Some solutions will be described below.

[Method for Combining all Equations of Motion and Solving Combined Equation]

First, a method for combining all the equations of motion of the hammer model, string model and main body model and solving the combined equation is described. When Newmark-β method is applied to the above-mentioned "equation of motion of hammer-string-body" (simultaneous nonlinear ordinary differential equation), it is possible to derive a simultaneous nonlinear algebraic equation having "acceleration or acceleration increment of the center of the hammer", "acceleration or acceleration increment on the modal coordinates of each natural vibration mode of the string", and "acceleration or acceleration increment on the modal coordinates of each natural vibration mode of the main body" as unknown quantities. Here, "acceleration or acceleration increment" is described because numerical integration known as Newmark-β method includes two algorithms one of which has acceleration as an unknown quantity and the other of which has acceleration increment as an unknown quantity.

The arithmetic processing unit 120 which will be described below can sequentially decide the unknown quantities on the discrete time base by applying Newton's method to the simultaneous nonlinear algebraic equation, or by deriving a simultaneous linear algebraic equation according to a piecewise-linearization method (Non-patent Reference 3) and then applying a direct method (for example, LU decomposition) or a repetition method (for example, conjugate gradient method) to the simultaneous linear algebraic equation. A configuration of a case in which arithmetic processing is performed through the method for combining all the equations of motion and solving the combined equation is explained with reference to FIG. 6.

Figure 6:
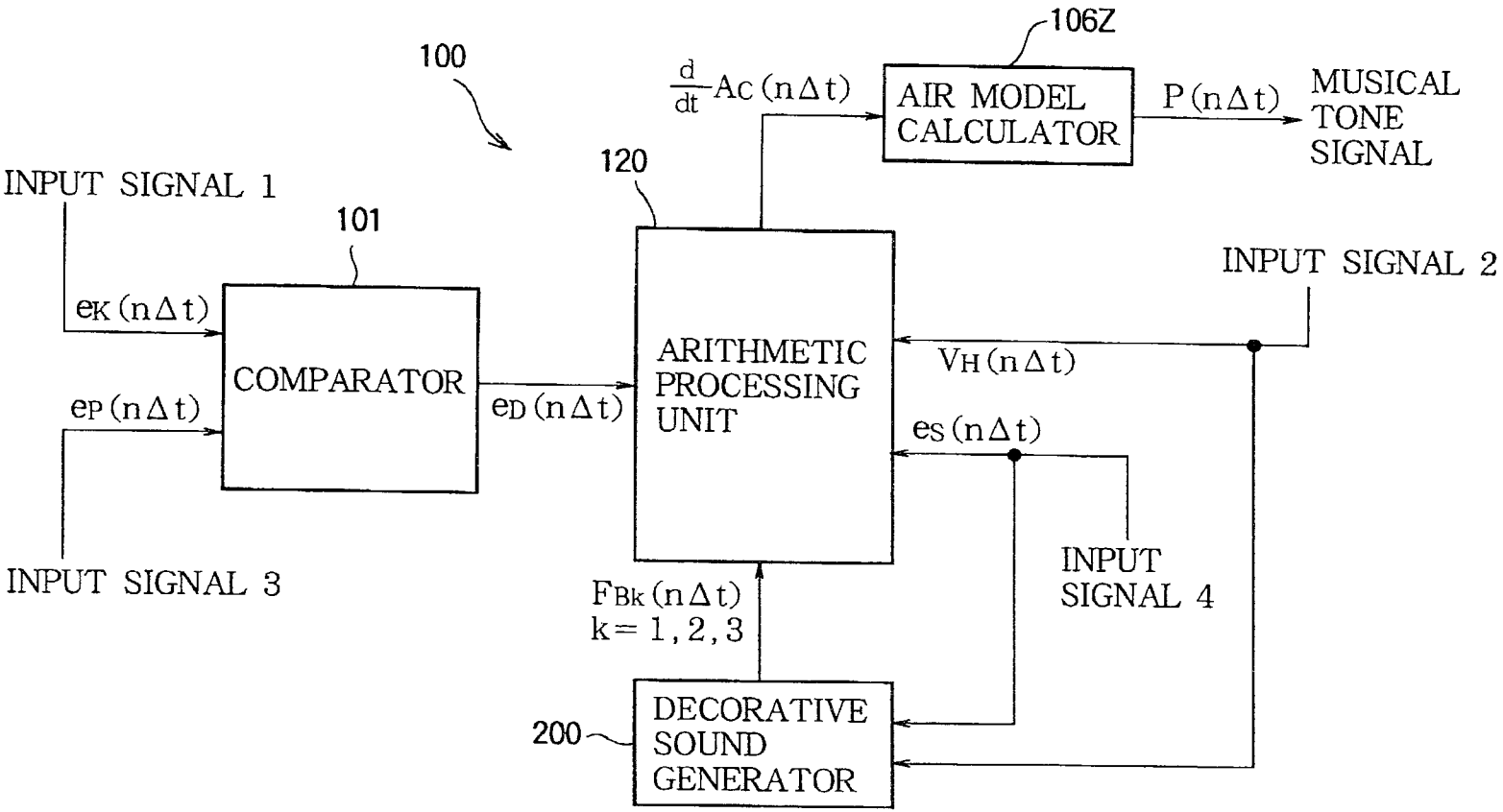
FIG. 6 is a block diagram showing a configuration of a musical tone signal synthesis unit including an arithmetic processing unit according to the first embodiment of the invention.

FIG. 6 is a block diagram showing a configuration of the musical tone signal synthesis unit 100 including the arithmetic processing unit 120. The musical tone signal synthesis unit 100 that performs arithmetic processing using the method for combining the all the equations and solving the combined equation includes the comparator 101, arithmetic processing unit 120, and an air model calculator 106Z.

The arithmetic processing unit 120 performs arithmetic processing using the "equation of motion of hammer-string-body" corresponding to a combination of calculations of the hammer model calculator 103, string model calculator 104 and main body model calculator 105. The arithmetic processing unit 120 receives $e_D(n\Delta t)$ from the comparator 101, acquires the second input signal $V_H(n\Delta t)$ and the fourth signal $e_S(n\Delta t)$, accepts $F_{Bk}(n\Delta t)$ for correcting $f_{Bk}(n\Delta t)$ from the decorative sound generator 200, and sequentially calculate and decide the above-described unknown quantities according to calculations using the received information and the "equation of motion of hammer-string-body". Here, information $d/dt(A_C(n\Delta t)$ that represents "velocity on the modal coordinates of each natural vibration mode of the main body" from among the unknown quantities is output to the air model calculator 106Z.

Here, the "velocity on the modal coordinates of each natural vibration mode of the main body" may be an "nth order derivative (n=1, 2, . . . ) with respect to time of displacement on the modal coordinates of each natural vibration mode of the main body". The velocity may be simply calculated by numerical differentiation of the displacement when the displacement is known in advance and by numerical integration of acceleration when the acceleration is known in advance.

[Solving Method for Each Substructure]

There will be described a method for solving the equations of motion of the hammer model, string model and main body model for each substructure (hereinafter, the hammer model calculator 103, string model calculator 104, and main body model calculator 105 are collectively referred to as substructures). This method calculates values of variables $f_H^{[i_W]}(t)$, $f_{Bk}^{[i_B]}(t)$, $u_1(x_H,t)$, $u_k(x_D^{[i_D]},t)$, and $u_{Bk}^{[i_B]}(t)$ that represent interactions of substructures, which were omitted in the explanation of the above-mentioned "equation of motion of hammer-string-body", as positive values, and performs calculation for each substructure while exchanging the values between the substructures.

In the case where this solution is used, although unknown quantities regarding the string and main body are included when the equation of motion of the hammer (Equation (3)) is solved and unknown quantities regarding the main body are included when the equation of motion of the string for each mode (Equations (14), (15) and (16)) is solved, it is possible to temporarily determine the unknown quantities regarding the string and main body by extrapolating previous values and perform repeated calculations, to thereby achieve stable calculation. Three examples using different numerical integration methods are described below.

A "method for deriving a difference equation" is explained as a first example.

A series of difference equations are derived by applying the centered difference method to the equation of motion of the hammer (Equation (3)), and applying bilinear s-z transform to the equation of motion of the string for each mode (Equations (14), (15) and (16)) and the equation of motion of the main body for each mode (Equation (32)). Each difference equation can be solved by general secondary IIR filter computation. In this method, values of "displacement of the hammer center", "displacement on the modal coordinates of each natural vibration mode of the string", and "displacement on the modal coordinates of each natural vibration mode of the main body" are set to unknown quantities, and the respective values are sequentially determined on the discrete time base.

"Gelerking method" is explained as a second example.

An algorithm that sets "acceleration and jerk of the hammer center", "acceleration and jerk on the modal coordinates of each natural vibration mode of the string", and "acceleration and jerk on the modal coordinates of each natural vibration mode of the main body" as unknown quantities and sequentially determines the values on the discrete time base by applying a Gelerking method (Non-patent Reference 4) having a cubic function regarding time as a test function to the equation of motion of the hammer (Equation (3)), the equation of motion of the string for each mode (Equations (14), (15) and (16)), and the equation of motion of the main body for each mode (Equation (32)). Here, when a Gelerking method having a quartic function instead of a cubic function regarding time as a test function is used, an algorithm that sets acceleration, jerk and snap as unknown quantities is obtained.

(Non-patent Reference 4: Kagawa Yukio, Vibroacoustic Engineering according to Finite Element Method/Basics and Applications, Baihukan, 1981)

"Newmark-β method" is explained as a third example.

The Newmark-β method is applied to the equation of motion of the hammer (Equation (3)), the equation of motion of the string for each mode (Equations (14), (15) and (16)), and the equation of motion of the main body for each mode (Equation (32)), to obtain an algorithm that sets "acceleration or acceleration increment of the hammer center", "acceleration or acceleration increment on the modal coordinates of each natural vibration mode of the string", and "acceleration or acceleration increment on the modal coordinates of each natural vibration mode of the main body" to unknown quantities and sequentially determine the values of the unknown quantities on the discrete time base.

[Intermediate Method Between Method for Combining all Equations of Motion and Solving Combined Equation and Solving Method for Each Substructure]

It is possible to use an intermediate method between the above-described method for combining all the equations and solving the combined equation and the solving method for each substructure. For example, the hammer model and the string model are combined and the main body model is separately solved. Otherwise, the hammer model is solved first, and then the string model and the main body model are combined and solved.

As described above, unknown quantities "displacement of the hammer center", "displacement on the modal coordinates of each natural vibration mode of the string", and "displacement on the modal coordinates of each natural vibration mode of the main body" may be acceleration, jerk, etc. based on the solution. Furthermore, considering that the velocity can be easily calculated according to numerical differentiation of displacement or numerical integration of acceleration, the "displacement of the hammer center", "displacement on the modal coordinates of each natural vibration mode of the string" and "displacement on the modal coordinates of each natural vibration mode of the main body" may be nth order derivatives (n=1, 2, . . . ) of displacement with time. Other displacements may also be nth order derivatives thereof. For example, displacement of the string support may be an nth order derivative (n=1, 2, . . . ) thereof with respect to the time.

The air model calculator 106 receives $A_C(n\Delta t)$ output from the main body model calculator 105 and outputs $P(n\Delta t)$ obtained from the following calculation using the received signal.

The air model calculator 106 will now be explained.

Unsteady sound pressure at an arbitrary observation point in the air, emitted from the main body in an arbitrary three-dimensional shape, can be calculated according to a method represented by the following Equation, that is, a method of performing convolution of an "impulse response function between the velocity on the modal coordinates of each natural vibration mode of the main body and the sound pressure at the observation point in the air" and the "velocity on the modal coordinates of each natural vibration mode of the main body" for each natural vibration mode of the main body, and calculating the total sum of convolution results.

$$P^{[i_P]}(t) = \sum_{m=1}^{M} \int_0^t \bar{h}^{[i_P][m]}(\tau) \frac{d}{d\tau} A_C^{[m]}(t-\tau) d\tau \tag{35}$$

where $$\bar{h}^{[i_P][m]}(t) = \frac{1}{2\pi} \int_{-\infty}^{\infty} \bar{H}^{[i_P][m]}(w) e^{jwt} dw \tag{36}$$

$$\bar{H}^{[i_P][m]}(w) = \sum_{i_G=1}^{l_G} H^{[i_P][i_G]}(w) \phi_G^{[i_G][m]} \tag{37}$$

where j denotes an imaginary number unit, and w denotes an angular frequency.

$H^{[iP][iG]}(w)$ included in Equation (37), that is, a "frequency response function between the velocity of each sound emission element of the main body and the sound pressure at the observation point in the air", can be calculated by performing frequency response analysis using commercial boundary element method software on the discrete frequency base for the main body in an arbitrary three-dimensional shape. In addition, Equation (36) can be calculated according to normal Inverse Fast Fourier Transform (IFFT) and integration included in Equation (37) can be calculated according to a normal Finite Impulse Response (FIR) filter method.

Moreover, it is possible to sequentially calculate an output signal from the air model, that is, sound pressure $P^{[iP]}(n\square t)$ on the discrete time base (t=n□t; n=0, 1, 2, . . . ), using $Ac^{[m]}(n\square t)$ (m=0, 1, 2, . . . , M) or derivative of $Ac^{[m]}(n\square t)$ (m=0, 1, 2, . . . , M) with time output from the main body model calculator 105 and to output the output signal as a musical tone signal.

Here, it is possible to achieve remarkably fast computation by using a method referred to as fast convolution which performs convolution in Equation (35) in the frequency domain instead of the time domain. At this time, it is preferable to perform IFFT computation included in fast convolution after summing frequency domain convolution results for respective natural vibration modes of the main body rather than performing the IFFT computation for each natural vibration mode of the main body.

The configuration of the musical tone signal synthesis unit 100 has been explained.

As described above, the musical tone signal synthesis unit 100 can generate a pseudo piano sound that realistically expresses characteristics of a piano sound of a natural musical instrument, such as an extensive stereoscopic sound generated when the whole musical instrument vibrates three-dimensionally, a ringing sound heard when strings in middle-and-low ranges are struck, musical nuance varied based on an intensity of key depression or a pressing intensity of a pedal, etc. Furthermore, it is possible to control properties of the sounds to be identical to the property of the piano corresponding to a natural musical instrument. Moreover, the pseudo piano sound can express even a decorative sound such as a deck sound.

Specifically, it is possible to control a level of ringing sound by changing a parameter such as a string length (corresponding to a distance between the string supports) or a string strike ratio (corresponding to "string length"/"distance between the string support at the bearing and the string struck point"). In the following, the ringing sound will be described particularly using Equation (15). However, the ringing sound will be explained according to Equation (38) obtained by omitting the displacement of the string support, displacement of y-direction of the string and the internal viscous damping coefficient of the string from Equation (15) for easiness of explanation.

$$\left\{\frac{d^2}{dt^2} + 2\zeta_2^{[i2]} w_2^{[i2]} \frac{d}{dt} + \left(w_2^{[i2]}\right)^2\right\} A_2^{[i2]}(t) = c_3^2 \frac{1}{l}\left(\frac{\pi}{l}\right)^3 i_2 \left\{\sum_{m_1=1}^{M_1}\sum_{m_1'=1}^{M_1} m_1 m_1' \Gamma_{m_1 m_1' i_2} A_1^{[m_1]}(t) A_1^{[m_1']}(t)\right\} \quad (38)$$

$$i_2 = 1, 2, \ldots, M_2$$

While Equation (38) corresponds to the equation of motion of i2-th natural vibration of the longitudinal vibration of the string, it is possible to consider Equation (38) as the equation of motion of 1 degree-of-freedom viscous damping forced vibration system by regarding the right side of Equation (38) as a periodic external force. As well known, the general solution of this equation is composed of a sum of a damping free vibration solution (general solution of a homogeneous equation) and a continuous forced vibration solution (special solution of a nonhomogenous equation). The forced vibration solution has a property that the system vibrates at the frequency of periodic external force, the amplitude of the frequency increases as the frequency becomes approximate to the natural frequency of the system, and resonance occurs when the frequency and the natural frequency correspond to each other. Now, it is assumed that each natural vibration regarding the bending vibration of the string is harmonic vibration, as represented by Equation (39).

$$A_1^{[m1]}(t) = a_1^{[m1]} \sin 2\pi f_1^{[m1]} t, A_1^{[m'1]}(t) = a_1^{[m'1]} \sin 2\pi f_1^{[m'1]} t \quad (39)$$

where $a_1^{[m_1]}$ and $a_1^{[m'_1]}$ are constants, and $f_1^{[m_1]}$ and $f_1^{[m'_1]}$ represent frequencies of z-direction bending vibration of the string.

At this time, contents in brackets of the right side of Equation (38) are derived according to Equation (40).

$$\sum_{m_1=1}^{M_1}\sum_{m_1'=1}^{M_1} m_1 m_1' \Gamma_{m_1 m_1' i_2} A_1^{[m_1]}(t) A_1^{[m_1']}(t) = \frac{l}{4}\sum_{m_1=1}^{M_1-i_2} m_1(m_1+i_2) a_1^{[m_1]} a_1^{[m_1+i_2]} \left\{\cos 2\pi\left(f_1^{[m_1]} - f_1^{[m_1+i_2]}\right)t - \cos 2\pi\left(f_1^{[m_1]} + f_1^{[m_1+i_2]}\right)t\right\} + \frac{l}{8}\sum_{m_1=1}^{i_2-1} m_1(i_2-m_1) a_1^{[m_1]} a_1^{[i_2-m_1]} \left\{\cos 2\pi\left(f_1^{[m_1]} - f_1^{[i_2-m_1]}\right)t - \cos 2\pi\left(f_1^{[m_1]} + f_1^{[i_2-m_1]}\right)t\right\} \quad (40)$$

$$i_2 = 1, 2, \ldots, M_2$$

In consideration of a series generated by term $\cos 2\pi(f_1^{[m_1]}+f_1^{[m_1+i_2]})$ included in Equation (40) with $i_2$ fixed, when "deviation from harmonics series frequency of $(2m_1+i_2)$th frequency $f_1^{[m_1]}+f_1^{[m_1 i_2]}$ of the series" is calculated, it is confirmed that the deviation corresponds to approximately a quarter of "deviation from harmonics series frequency of $(2m_1+i_2)$th natural frequency $f_1^{[2m1+i2]}$ of bending vibration" when $i_2$ is small. It is known that a supplementary series having a frequency deviation from a harmonics series, which corresponds to approximately a quarter of a main series, is present in a partial tone series of the piano according to analysis of the piano sound of a natural musical instrument, and thus the series generated from the above-mentioned term corresponds to the supplementary series. The deviation gradually increases as $i_2$ increases.

Furthermore, it can be understood that a series formed by term $\cos 2\pi(f_1^{[m1]}-f_1^{[i2-m1]})$ included in Equation (40) also contributes to formation of the supplementary series while the level of contribution is lower than that of the above-mentioned term.

An expression obtained by applying Equation (40) to Equation (38) represents that resonance occurs when $(2m_1+i_2)$th frequency $f_1^{[m1]}+f_1^{[m1+i2]}$ of the supplementary series corresponds to an $i_2$-th natural frequency of the longitudinal vibration of the string. This is mathematical explanation about the fact that a level of a supplement series partial tone increases when the frequency of an odd-numbered partial tone of the supplementary series corresponds to an odd-numbered natural frequency of the longitudinal vibration of the string or when the frequency of an even-numbered partial tone of the supplementary series corresponds to an even-numbered natural frequency of the longitudinal vibration of the string so as to become a ringing sound, more analytically, the fact that a ringing sound is generated when the sum of an odd-numbered natural frequency and an even-numbered natural frequency of the bending vibration of the string corresponds to an odd-numbered natural frequency of the longitudinal vibration of the string, or when the sum of a pair of odd-numbered natural frequencies or a pair of even-numbered natural frequencies of the bending vibration of the string corresponds to an even-numbered natural frequency of the longitudinal vibration of the string (Non-patent Reference 5), in addition to a characteristic phenomenon of the piano sound of the natural musical instrument that a supplementary series having a frequency deviation from a harmonics series, which corresponds to an approximately quarter of the main series, is present in a partial tone series of the piano.

(Non-patent Reference 5: J. Ellis, Longitudinal model in piano strings: Results of new research, Piano Technician journal, pp. 16-23, May 1998).

Moreover, for a ringing sound, such as ting-a-ling, tinkle-tinkle, etc., $15(=7+8=2\times7+1)^{th}$ of the supplementary series and $15(=6+9=2\times6+3)^{th}$ of the supplementary series have slightly different frequencies, and thus it is possible to explain that the frequency difference generates a ringing sound. Terms $\cos 2\pi(f_1^{[m1]}-f_1^{[m1+i2]})$ and $\cos 2\pi(f_1^{[m1]}-f_1^{[i2-m1]})$ included in Equation (44) represent presence of a partial tone having a frequency slightly higher than the natural frequency of the bending vibration.

When the material constant of the string is fixed, the natural frequency of the longitudinal vibration of the string depends only on the string length according to Equation (18). A wound string (string with a copper wire winding a steel core) generally used for a low range of the piano is not limited thereto.

In a range from about the thirtieth key to about the fortieth key of the standard 88-key piano, the frequency of $15(=7+8=2\times7+1)^{th}$ of the supplementary series and the basic natural frequency of the longitudinal vibration of the string may be close to each other due to setting of the string length. Even in this case, it is possible to prevent a ring sound level from excessively increasing by setting the string strike ratio to 7 or 8.

This is because that seventh or eighth natural vibrations of the bending vibration are dropped when the string strike ratio is set to 7 or 8 so that the $15(=7+8=2\times7+1)^{th}$ of the supplementary series is not generated although the $15(=7+8=2\times7+1)^{th}$ of the supplementary series is a product of the seventh natural vibration and eighth natural vibration of the bending vibration. Though the $15(=6+9=2\times6+3)^{th}$ of the supplementary series and the like exist in this case, they do not resonate with the basic natural vibration of the longitudinal vibration.

The ringing sound generation mechanism and design parameters (string length and string strike ratio) for controlling the level of the mechanism have been explained. Since the longitudinal vibration of the string barely has capability of emitting a sound to the air, it is necessary to consider a "three-dimensional coupled vibration mechanism of the string and main body" (which includes design parameters such as a setting angle of the string for the main body, a bridge form, etc.) and "three-dimensional sound emission mechanism of the main body" (which includes the bridge form) in addition to the above-described "nonlinear (finite amplitude) vibration mechanism of the string" in order to hear the ringing sound as a sound.

In the development of the piano, a natural musical instrument, improving a piano sound corresponds to seeking an optimal solution of a complicated system called a piano. However, finding the optimal solution according to a conventional trial-and-error method has poor efficiency in a massive acoustic structure having a large number of design parameters and error factors (errors in properties of natural materials or errors in works performed by people, such as sound adjustment). The present invention is to quantitatively disclose a causal relationship between specifications (cause) and sound (effect) of the piano so as to contribute to improvement of piano development efficiency as a design simulator. In addition, a musical tone synthesis method according to physical models has an advantage that supernatural effect (for example, a piano that is too large to manufacture practically) beyond realistic simulation can be virtually generated.

Second Embodiment

A second embodiment describes a musical tone signal synthesis unit 100A configured without using the decorative sound generator 200 in the aforementioned first embodiment.

Figure 7:
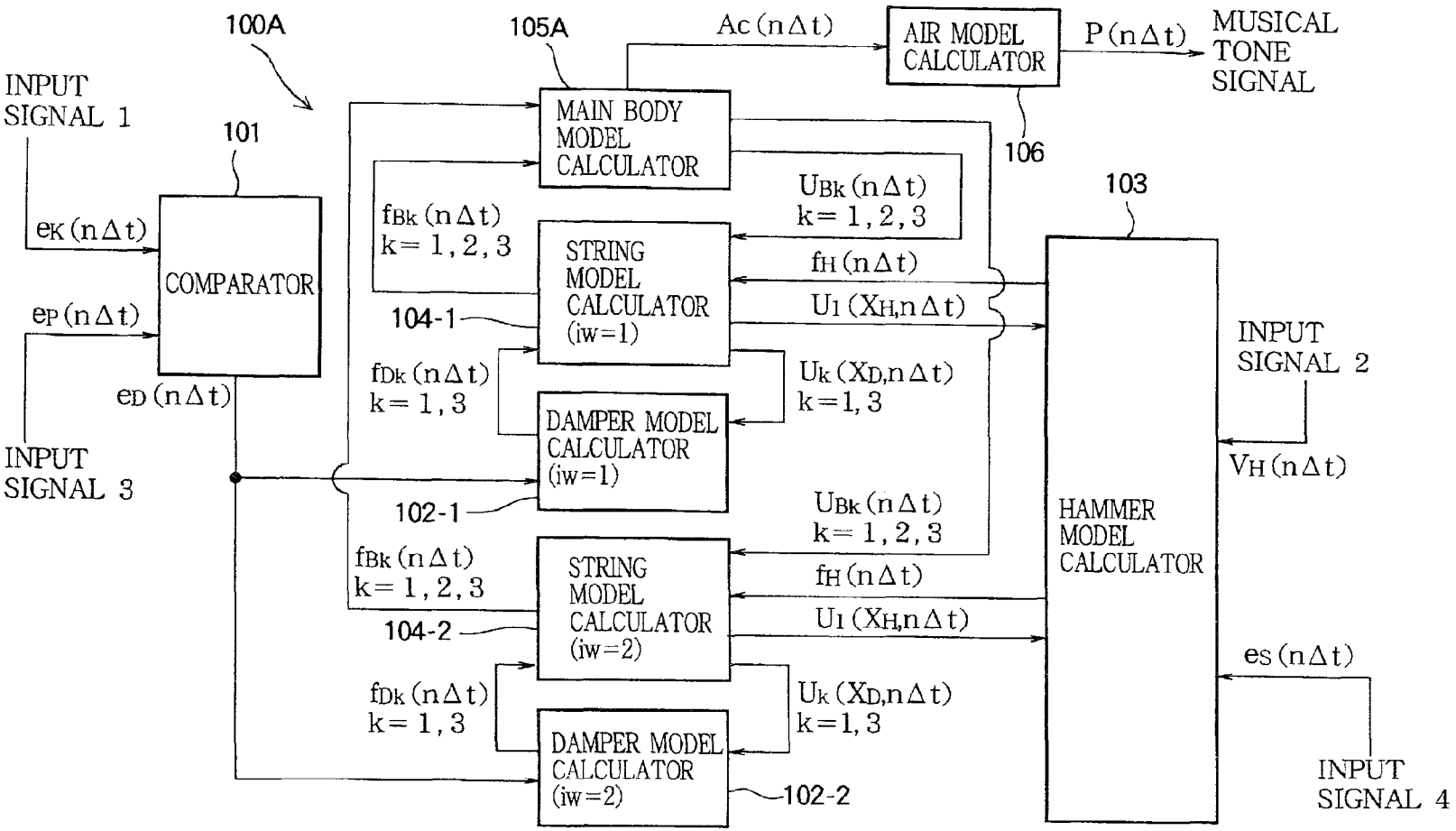
FIG. 7 is a block diagram showing a configuration of a musical tone signal synthesis unit according to a second embodiment of the invention.

FIG. 7 is a block diagram showing a configuration of the musical tone signal synthesis unit 100A. The musical tone signal synthesis unit 100A does not include the decorative sound generator 200 of the first embodiment, and thus $f_{Bk}(n\Delta t)$ output from the string model calculator 104 is not corrected. Accordingly, a main body model calculator 105A of the musical tone signal synthesis unit 100A differs from the main body model calculator 105 according to the first embodiment, and uncorrected $f_{Bk}(n\Delta t)$ output from the string model calculator 104 is obtained. Detailed design for the main body model calculator 105A is identical to that of the first embodiment. Components other than the main body model calculator 105A are identical to those in the first embodiment so that explanations thereof are omitted.

Since the musical tone signal synthesis unit 100A does not use the decorative sound generator 200 as described above, it is suitable for a case in which a decorative sound such as a deck sound does not need to be included in a reproduced pseudo piano sound.

Third Embodiment

A third embodiment describes a case in which computation different from that performed by the string model calculator 104 in the first and second embodiments is carried out. This embodiment explains a musical tone signal synthesis unit 100B having a string model calculator 104B that substitutes the string model calculator 104 in the first embodiment to perform computation different from that of the string model calculator 104 of the first embodiment.

Figure 8:
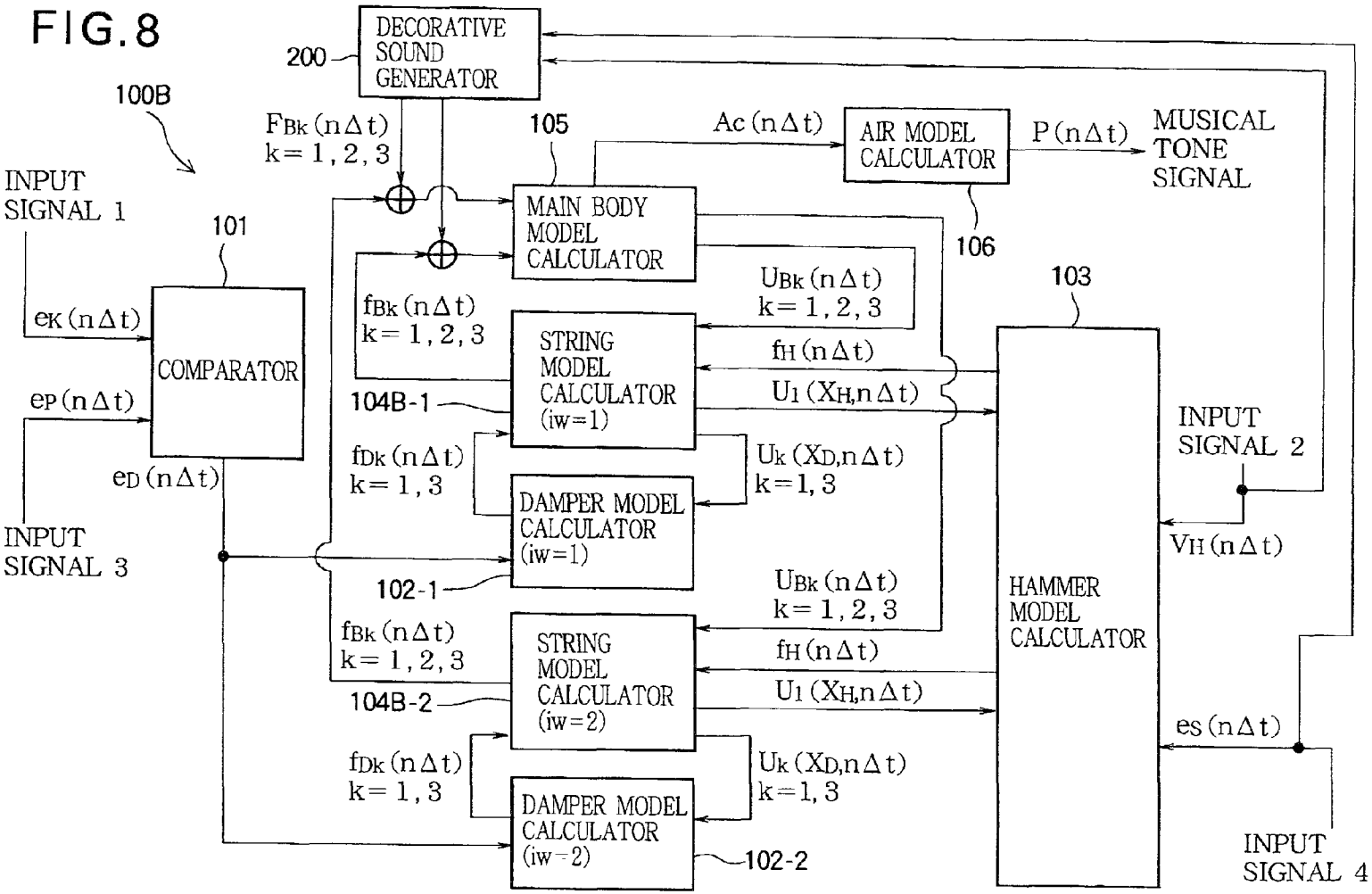
FIG. 8 is a block diagram showing a configuration of a musical tone signal synthesis unit according to a third embodiment of the invention.

FIG. 8 is a block diagram showing a configuration of the musical tone signal synthesis unit 100B. The musical tone signal synthesis unit 100B has the same components as those of the musical tone signal synthesis unit 100 according to the first embodiment, except a string model calculator 104B (104B-1 and 104B-2), and thus explanations thereof are omitted. The string model calculator 104B generates a cyclic signal representing vibration of the string 21*e* using a closed-loop including a delay means (delay element) and a characteristic control element (filter), and performs computation (waveguide model) of vibration of the string 21*e*.

Figure 9:
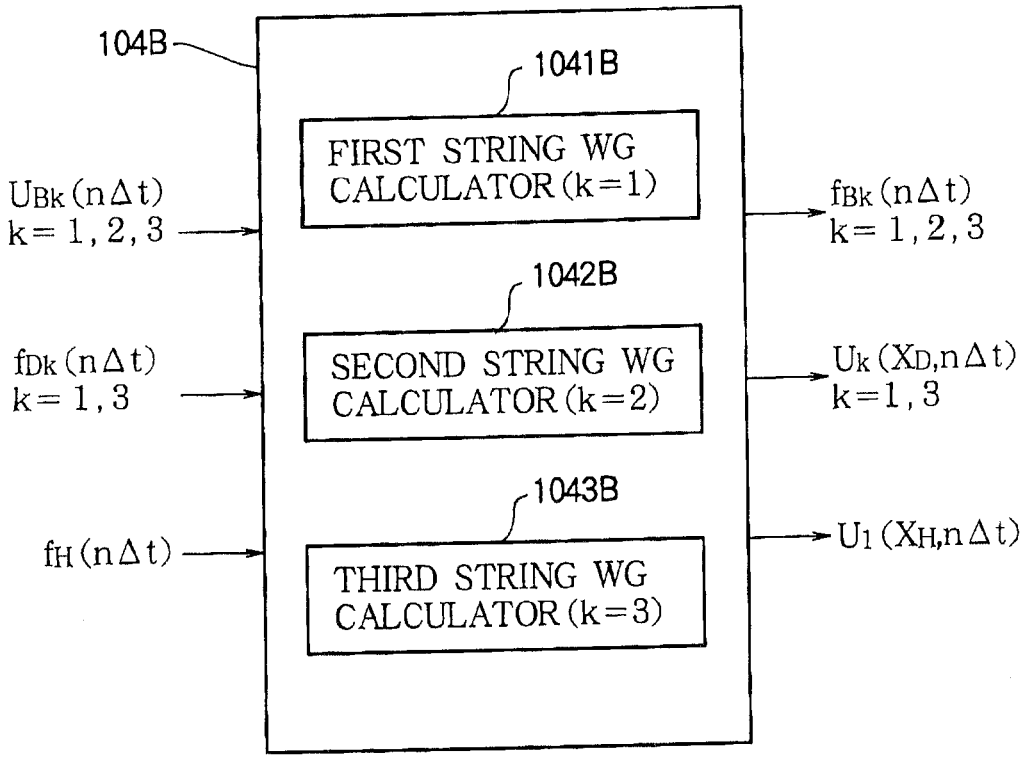
FIG. 9 is a block diagram showing a configuration of a string model calculator according to the third embodiment of the invention.

FIG. 9 is a block diagram showing a configuration of the string model calculator 104B. The string model calculator 104B includes a first string WG calculator 1041-B for calculating vibration of k=1 (z direction) of the string 21*e*, a second string WG calculator 1042B for calculating vibration of k=2 (x direction) of the string 21*e* and a third string WG calculator 1043B for calculating vibration of k=3 (y direction) of the string 21*e*. These components will now be explained with reference to FIG. 10.

Figure 10:
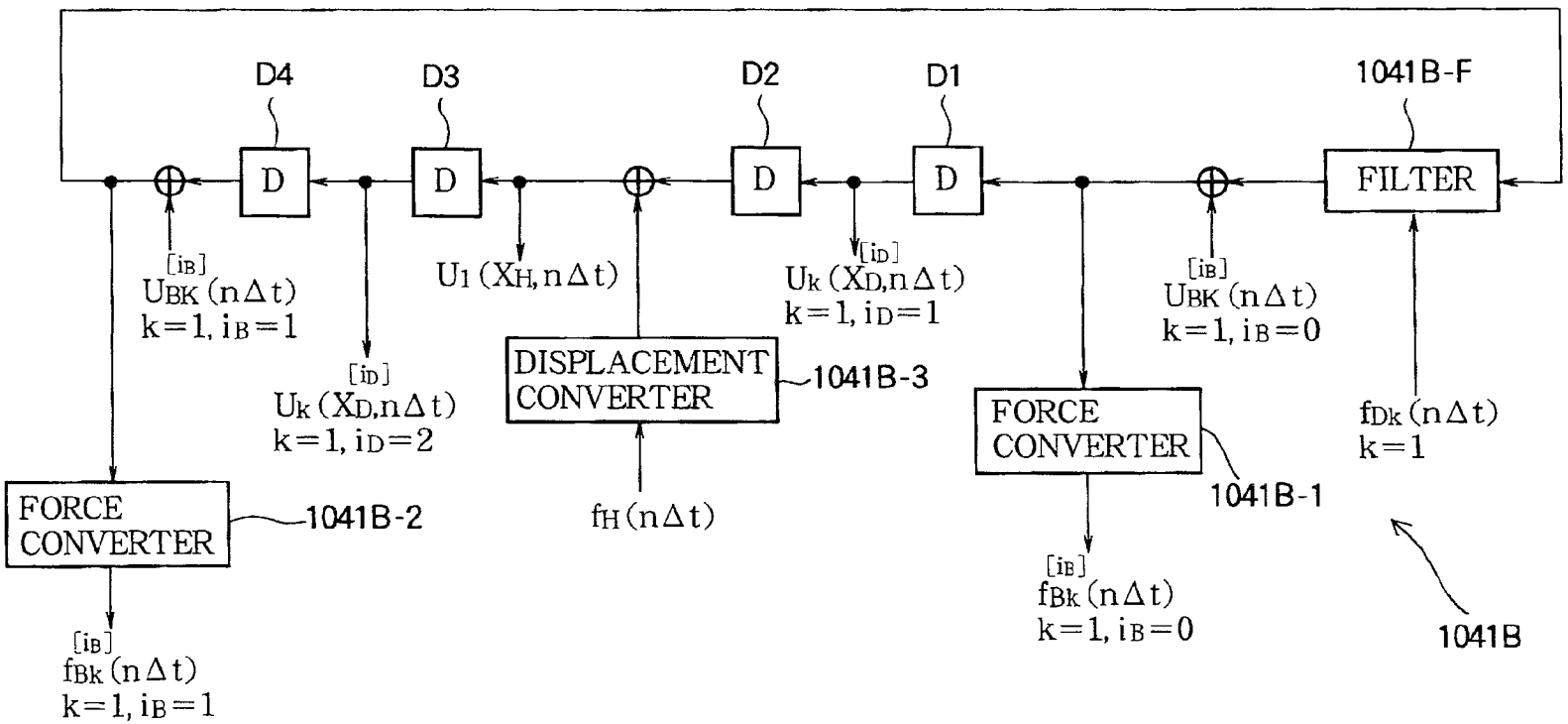
FIGS. 10(*a*), 10(*b*) and 10(*c*) are block diagrams showing configurations of first, second and third string WG calculators according to the third embodiment of the invention.
Figure 10:
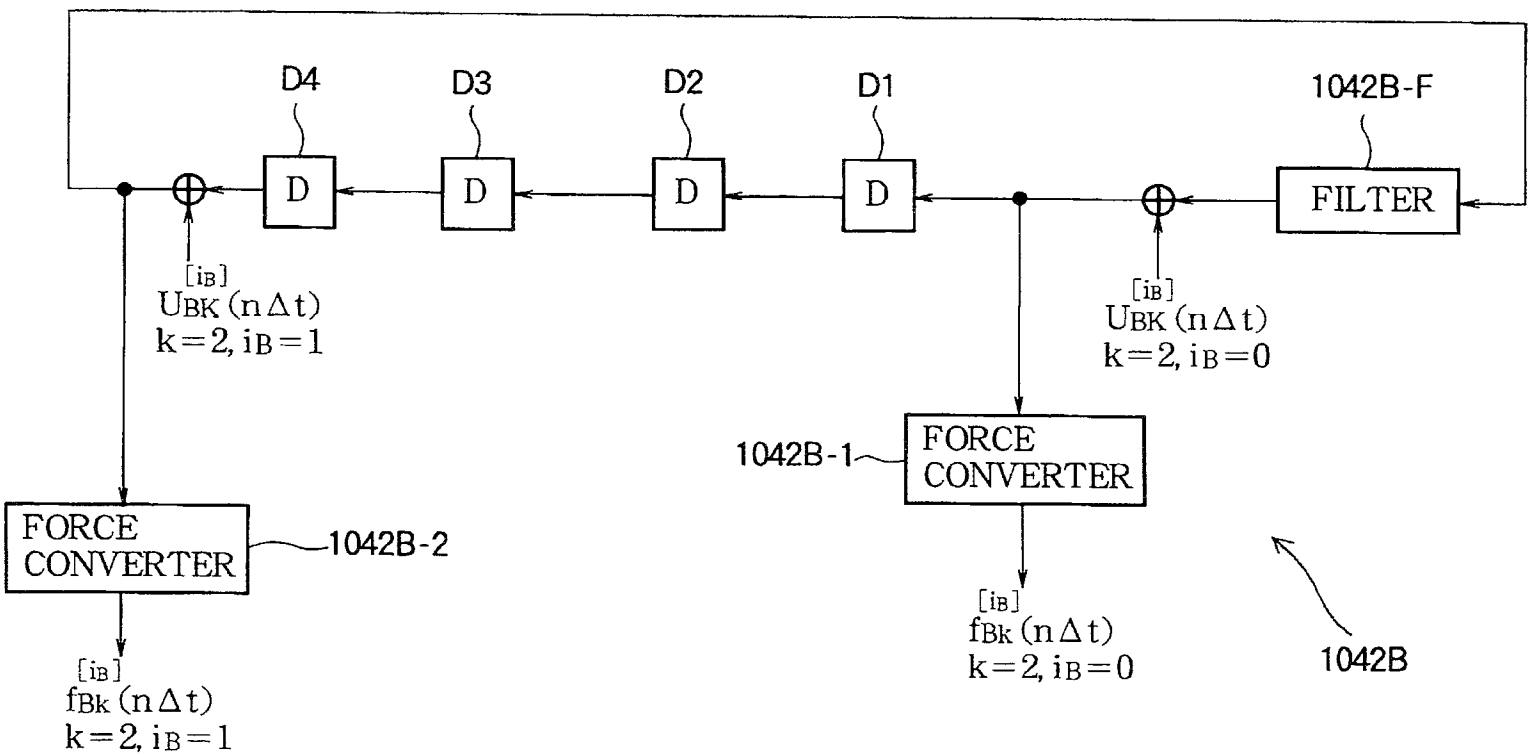
Figure 10:
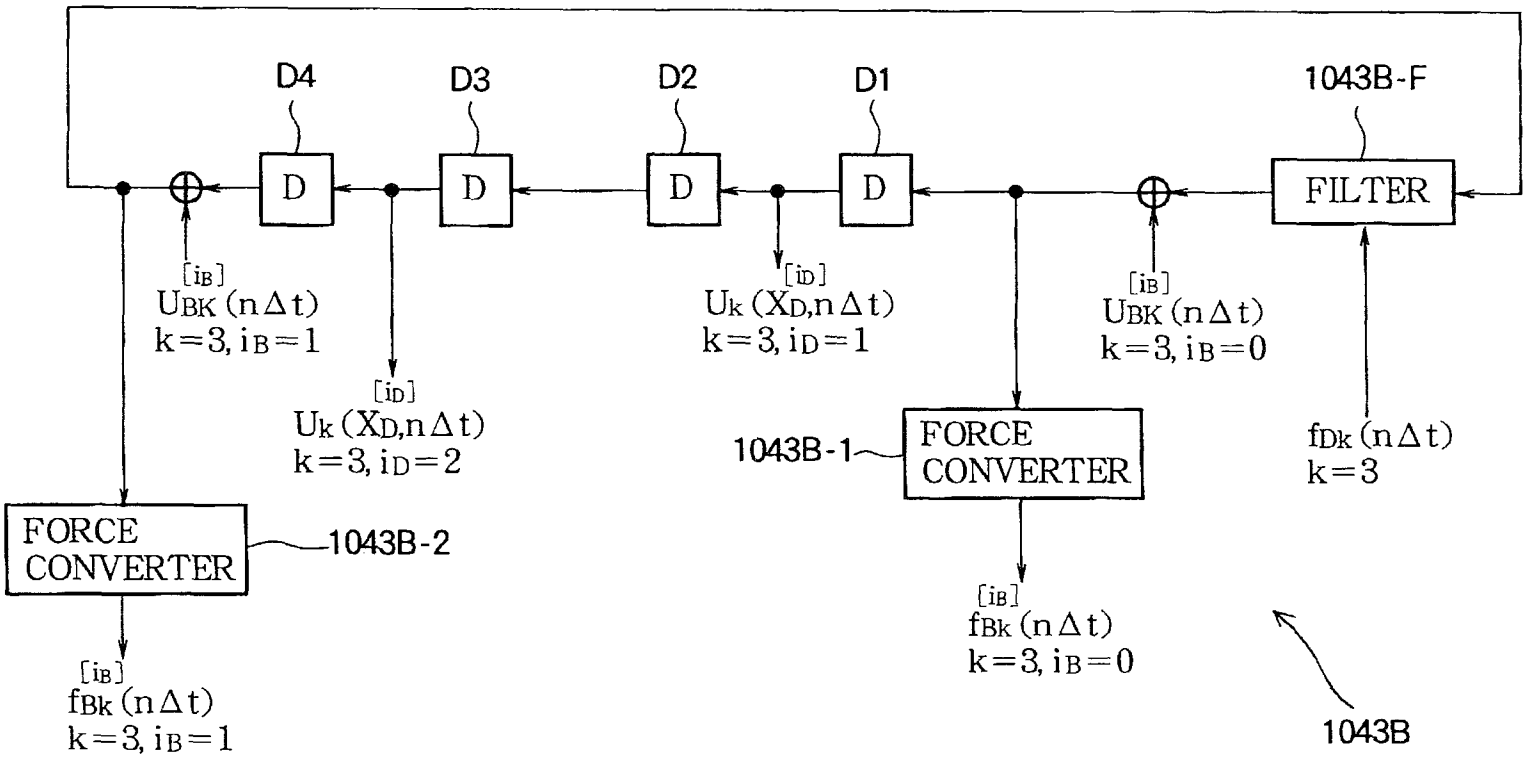

FIG. 10 is a block diagram showing a configuration of the first string WG calculator 1041B (FIG. 10(*a*)), a configuration of the second string WG calculator 1042B (FIG. 10(*b*)), and a configuration of the third string WG calculator 1043B (FIG. 10(*c*)).

As shown in FIG. 10(*a*), the first string WG calculator 1041B has a closed loop including delays D1, D2, D3 and D4 and a filter 1041B-F. In addition, the first string WG calculator 1041B includes force converters 1041B-1 and 1041B-2 and a displacement converter 1041B-3.

The delays D1, D2, D3 and D4 respectively perform delaying processes at set delay time. A delay time (sum of delay times of the delays D1, D2, D3 and D3 and delay time of the filter 1041B-F) from when an output from the filter 1041B-F circulates through the closed loop to when the output is output from the filter 1041B-F corresponds to a delay time from when a wave at a certain point on the string 21*e*, which reproduces vibration, is propagated through the string 212 to when the wave is returned to the point via both string supports. The string 21*e* of the piano is tuned depending on the corresponding pitch, and thus the delay time is adjusted to correspond to the corresponding pitch. Furthermore, the delay time of each of the delays D1, D2, D3 and D4 is determined such that a portion between neighboring delays corresponds to a point on the string 21*e*. In this embodiment, the delay time of each delay is determined such that a portion between neighboring delays corresponds to a contact portion of the hammer 21*c*, damper 21*f* ($i_D$=1, 2), and string supports (bridge 21*ea* ($i_B$=0) and bearing 21*eb* ($i_B$=1)) in the string 213. For example, a ratio of the length of a contact portion of the bridge 21*ea* and the bearing 21*eb* to the length of a contact portion of the bearing 21*eb* and the hammer 21*c* corresponds to a ratio of the sum of the delay times of the delays D1 and D2 to the sum of the delay times of the delays D3 and D4.

Furthermore, the damper 21*f* and the string 21*e* come into contact with each other at two contact points ($i_D$=1, 2) in this embodiment. In addition, it is considered that each adder in the closed loop has no delay by incorporating delay due to the actual adder into a neighboring delay and the filter.

The filter 1041B-F simulates a frequency characteristic variation or vibration damping due to propagation of vibration in the string 21*e* and attenuates a cyclic signal in the closed loop. The filter 1041B-F is controlled such that it attenuates the cyclic signal faster as $f_{Dk}(n\Delta t)$ (k=1) input thereto increases. In addition, the filter 1041B-F may have a frequency characteristic that changes not only the cyclic signal but also the frequency distribution of the cyclic signal.

$u_{Bk}(n\Delta t)$ (k=1) output from the main body model calculator 105 and $f_H(n\Delta t)$ output from the hammer model calculator 103 are input as excitation signals to positions on the closed loop depending on positions acting on the string 21*e*. This generates the cyclic signal on the closed loop.

$u_{Bk}(n\Delta t)$ (k=1) is input to a position on the closed loop depending the string supports (bridge 21*ea* ($i_B$=0) and bearing 21*eb* ($i_B$=1)). In this embodiment, $u_{Bk}(n\Delta t)$ (k=1, $i_B$=0) is input to a point between the filter 1041B-F and the delay D1 and $u_{Bk}(n\Delta t)$ (k=1, $i_B$=1) is input to a point between the delay D4 and the filter 1041B-F.

$f_H(n\Delta t)$ is input to a position on the closed loop depending on a contact point of the hammer 21*c* and the string 21*e*, that is, a point between the delays D2 and D3. Here, $f_H(n\Delta t)$ is converted into a displacement by the displacement converter 1041B-3 and input. The displacement converter 1041B-3 converts $f_H(n\Delta t)$ by performing integration on time twice.

$f_{Dk}(n\Delta t)$ (k=1) output from the damper model calculator 102 is input to the filter 1041B-F and used for filter control.

$f_{Bk}(n\Delta t)$ (k=1) output from the string model calculator 104B to the main body model calculator 105, $u_k(x_H,n\Delta t)$ (k=1) output to the damper model calculator 102, and $u_1(x_H, n\Delta t)$ output to the hammer model calculator 103 are respectively read as cyclic signals in positions on the closed loop depending on positions acting on the string 21*e*.

$f_{Bk}(n\Delta t)$ (k=1) is output as is the above-mentioned $u_{Bk}(n\Delta t)$ (k=1). That is, $f_{Bk}(n\Delta t)$ (k=1, $i_B$=0) is output from a position between the filter 1041B-F and the delay D1 and $f_{Bk}(n\Delta t)$ (k=1, $i_B$=1) is output from a position between the delay D4 and the filter 1041B-F. At this time, cyclic signals on the closed loop represent displacements, and thus they are converted into $f_{Bk}(n\Delta t)$ (k=1) by the force converters 1041B-1 and 1041B-2. The force converters 1041B-1 and 1041B-2 convert displacements represented by cyclic signals output from the closed loop into $f_{Bk}(n\Delta t)$ (k=1) using the above-described Equation (25).

$u_k(x_D,n\Delta t)$ (k=1) is output from a position on the closed loop depending on the contact point of the damper 21*f* and the string 21*e*. In this embodiment, $u_k(x_D,n\Delta t)$ (k=1, $i_D$=1) is output from a position between the delays D1 and D2 and $u_k(x_D,n\Delta t)$ (k=1, $i_D$=2) is output from a position between the delays D3 and D4.

$u_1(x_H,n\Delta t)$ is output from a position on the closed loop depending on the contact point of the hammer 21*c* and the string 21*e*, a position between the delays D2 and D2 in this embodiment.

The second string WG calculator 1042B shown in FIG. 10(*b*) has parameters corresponding to k=2 instead of the parameters corresponding to k=1 in the first string WG calculator 1041B so that explanation thereof is omitted. The force converters 1042B-1 and 1042B-2 perform conversion using the above-mentioned Equation (26). Furthermore, a damping velocity of the filter 1042B-F is not controlled based on the damper because $f_{Dk}(n\Delta t)$ is not input thereto. In addition, the second string WG calculator 1042B does not have a configuration corresponding to the displacement converter since $f_H(n\Delta t)$ is not input thereto.

The third string WG calculator 1043B shown in FIG. 10(*c*) has parameters corresponding to k=3 instead of the parameters corresponding to k=1 in the first string WG calculator 1041B so that explanation thereof is omitted. In addition, the third string WG calculator 1043B does not have a configuration corresponding to the displacement converter as does the second string WG calculator 1042B since $f_H(n\Delta t)$ is not input thereto.

Accordingly, it is possible to easily calculate the string model as compared to the first embodiment.

The string model calculator 104B is not required to include all the first string WG calculator 1041B for calculating z-direction vibration of the string 21*e*, the second string WG calculator 104B for calculating x-direction vibration of the string 21*e*, and the third string WG calculator 1043B for calculating y-direction vibration of the string 21*e*, and may include at least a configuration for calculating the z-direction vibration of the string 21*e*. Accordingly, the string model calculator 104B may have a configuration including the first string WG calculator 1041B and the second string WG calculator 1042B without the third string WG calculator 1043B, or a configuration including the first string WG calculator 1041B and the third string WG calculator 1043B without the second string WG calculator 1042B.

MODIFICATIONS

While embodiments of the present invention have been described, the present invention can be implemented in various aspects as described below.

Modification 1

While the waveform data is generated from results of detection of displacements of the string supports in the state that the string 21*e* is not vibrated in the first (third) embodiment, it may be generated in another aspect.

Displacements of string supports when a specific key 21*a* is depressed at a specific velocity are detected in the state that the string 21*e* is vibrated. Then, a difference between $f_{Bk}(n\Delta t)$ calculated without being corrected by the decorative sound generator 200 of the musical tone signal synthesis unit 100 and force calculated from the detected displacements of the string supports may be used as the waveform data corresponding to $F_{Bk}(n\Delta t)$ on the assumption that a key 15*b* or 15*c* corresponding to the specific key 21*a* is depressed at a specific velocity under the same condition. In this case, $f_{Bk}(n\Delta t)$ input to the main body model calculator 105 is corrected to close to the force calculated from the detected displacements of the string supports.

The waveform data corresponding to $F_{Bk}(n\Delta t)$ may be generated by physically modeling a vibration waveform of the main body 21*j*, caused by generation of a deck sound.

Modification 2

While the decorative sound generator 200 corrects $f_{Bk}(n\Delta t)$ in the first (third) embodiment, it is possible to synthesize the musical tone signal P(n□t) and a decorative sound by generating a musical tone signal representing the decorative sound and adding it to the musical tone signal P(n□t) without correcting $f_{Bk}(n\Delta t)$. In this case, the waveform data stored in the storage unit 12 may be generated using a waveform obtained by recording a deck sound, generated when a specific key 21*a* is depressed in the state that the string 21*e* is not vibrated, at an arbitrary point in the air (for example, an observation point used to calculate the musical tone signal P(n□t)).

The waveform data may be generated using the method of Modification 1. That is, a difference between a signal obtained from a recording result when a specific key 21*a* is depressed at a specific velocity in the state that the string 21*e* is vibrated and the musical tone signal P(n□t) calculated in the musical tone signal synthesis unit 100 on the assumption that a key 15*b* or 15*c* corresponding to the specific key 21*a* is depressed at a specific velocity under the same condition may be used as the waveform data. The waveform data may be generated by physically modeling a vibration waveform of a deck sound.

Modification 3

While the decorative sound generator 200 corrects $f_{Bk}(n\Delta t)$ output from the string model calculator 104 and input to the main body model calculator 105 in the first (third) embodiment, the decorative sound generator 200 may correct $u_{Bk}(n\Delta t)$ output from the main body model calculator 105 and input to the string model calculator 104. In this case, the decorative sound generator 200 may generate decorative sound information that represents displacements of string supports depending on a decorative sound on the basis of the waveform data. Meanwhile, the waveform data may represent the displacements of the string supports depending on the decorative sound.

Modification 4

While the decorative sound generator 200 corrects $f_{Bk}(n\Delta t)$ in the first (third) embodiment, the decorative sound generator 200 may correct "nth order differentiation on a displacement on modal coordinates of each natural vibration mode of the string or time of the displacement". In this case, the waveform data stored in the storage unit 12 may be generated from a result obtained by separating the hammer 21*c* and detecting vibration in the string 21*e* to which a deck sound caused by depression of a specific key 21*a* is propagated using a sensor.

Modification 5

While the decorative sound generator 200 corrects $f_{Bk}(n\Delta t)$ in the first (third) embodiment, it is possible to acquire a signal from the conversion unit 110 in the main body model calculator 105 and perform a model computation on vibration caused by a deck sound generated due to collision of the key 21*a* and the deck.

Modification 6

While a deck sound is reproduced as a decorative sound in the first (third) embodiment, when an action sound is reproduced according to operations of the damper pedal 21*m* and the shift pedal 22*n*, the decorative sound generator 200 may acquire performance information, $e_P(n\Delta t)$ and $e_S(n\Delta t)$ output according to the operations. At this time, the decorative sound generator 200 may calculate operating velocity of the damper pedal 21*m* and shift pedal 21*n* and use the operating velocity to control the DCA 230, DCF 240, etc.

Modification 7

While vibration of the string 21*e* is calculated using equations of motion in the first and second embodiments and it is calculated using the closed loop having the delay element and characteristic control element in the third embodiment, any method that calculates the vibration of the string 21*e* using force acting on the string and the displacements of the string supports can be used.

Modification 8

While vibration of the string 21*e* is calculated using the closed loop having the delay element and characteristic control element in the third embodiment, vibration of the main body 21*j* may be calculated using the closed loop.

Modification 9

While the string model calculator 104 acquires $f_{Dk}(n\Delta t)$ (k=1, 3) output from the damper model calculator 102, $f_H(n\Delta t)$ output from the hammer model calculator 103, and $u_{Bk}(n\Delta t)$ (k=1, 2, 3) output from the main body model calculator 105 as the force acting on the string in the first (second or third) embodiment, the string model calculator 104 may acquire one or both of $f_{Dk}(n\Delta t)$ (k=1, 3) and $f_H(n\Delta t)$ calculated by a different calculation method. In addition, while the air model calculator 106 calculates the musical tone signal P(n□t) according to a computation using an air model on the basis of $A_C(n\Delta t)$ output from the main body model calculator 105 in the first (second or third) embodiment, the musical tone signal P(n□t) may be calculated by a different calculation method.

A configuration when both $f_{Dk}(n\Delta t)$ (k=1, 3) and $f_H(n\Delta t)$ are calculated by a different calculation method and the musical tone signal $P(n\Delta t)$ is calculated by a different calculation method without using the air model is explained with reference to FIG. 11.

Figure 11:
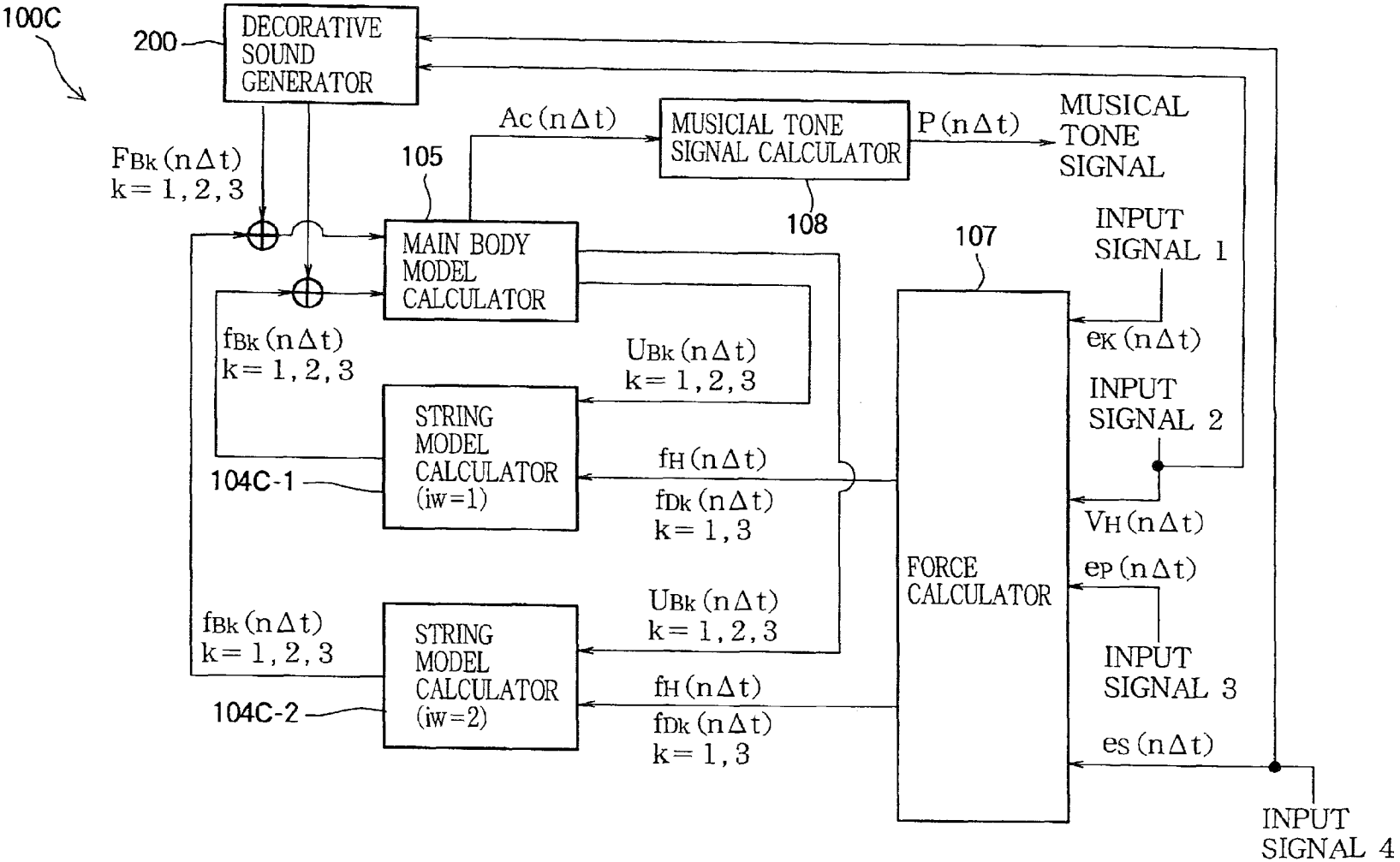
FIG. 11 is a block diagram showing a configuration of a musical tone signal synthesis unit according to modification 9 of the invention.

FIG. 11 is a block diagram showing a configuration of a musical tone signal synthesis unit 100C according to Modification 9 of the present invention. The musical tone signal synthesis unit 100C includes a force calculator 107 instead of the comparator 101, damper model calculator 102 and the hammer model calculator 103 in the first (second or third) embodiment and has a musical tone signal calculator 108 instead of the air model calculator 106 in the first (second or third) embodiment.

The force calculator 107 calculates information corresponding to $f_{Dk}(n\Delta t)$ (k=1, 3) and $f_H(n\Delta t)$ on the basis of each input signal output from the conversion unit 110 and input to the musical tone signal synthesis unit 100C and outputs the information to a string model calculator 104C.

The force calculator 107 calculates the information corresponding to $f_H(n\Delta t)$ using $u_1(x_H,n\Delta t)$ that is previously determined without using $u_1(x_H,n\Delta t)$ from the string model calculator 104C. The force calculator 107 may calculate $u_1(x_H, n\Delta t)$ on the basis of each input signal using a predetermined calculation expression.

In addition, the force calculator 107 calculates the information corresponding to $f_{Dk}(n\Delta t)$ (k=1, 3) using $u_k(x_D,n\Delta t)$ (k=1, 3) that is previously determined without using $u_k(x_D, n\Delta t)$ (k=1, 3) from the string model calculator 104C. The force calculator 107 may calculate $u_k(x_D,n\Delta t)$ (k=1, 3) on the basis of each input signal using a predetermined calculation expression.

While the force calculator 107 is substituted with the comparator 101, the damper model calculator 102 and the hammer model calculator 103 in the first (second or third) embodiment, it is possible to construct the hammer model calculator 103 in the same configuration as that in the first (second or third) embodiment and substitute the force calculator 107 for the comparator 101 and the damper model calculator 102. On the contrary, it is possible to construct the comparator 101 and the damper model calculator 102 in the same configurations as those in the first (second or third) embodiment and substitute the force calculator 107 for the hammer model calculator 103. That is, the force acting on the string may be calculated without using one or both of $u_1(x_H, n\Delta t)$ and $u_k(x_D,n\Delta t)$ (k=1, 3), used to calculate the force acting on the string in the first (second or third) embodiment, from among string model calculation results.

The musical tone signal calculator 108 calculates the musical tone signal P(n□t) on the basis of $A_C(n\Delta t)$ output from the main body model calculator 105. The musical tone signal calculator 108 may calculate the musical tone signal P(n□t) through a predetermined calculation expression using $A_C(n\Delta t)$. Here, the musical tone signal P(n□t) may not represent a non-stationary sound pressure at an arbitrary observation point in the air, and may represent vibration at an arbitrary position in the main body. Moreover, the musical tone signal calculator 108 may calculate the musical tone signal P(n□t) on the basis of $u_{Bk}(n\Delta t)$ (k=1, 2, 3) output from the main body model calculator 106 to the string model calculator 104C.

Modification 10

An electronic musical instrument from which the shift pedal 16*b* in the first (second or third) embodiment has been removed may be used. A configuration in this case will now be explained with reference to FIGS. 12 and 13.

Figure 12:
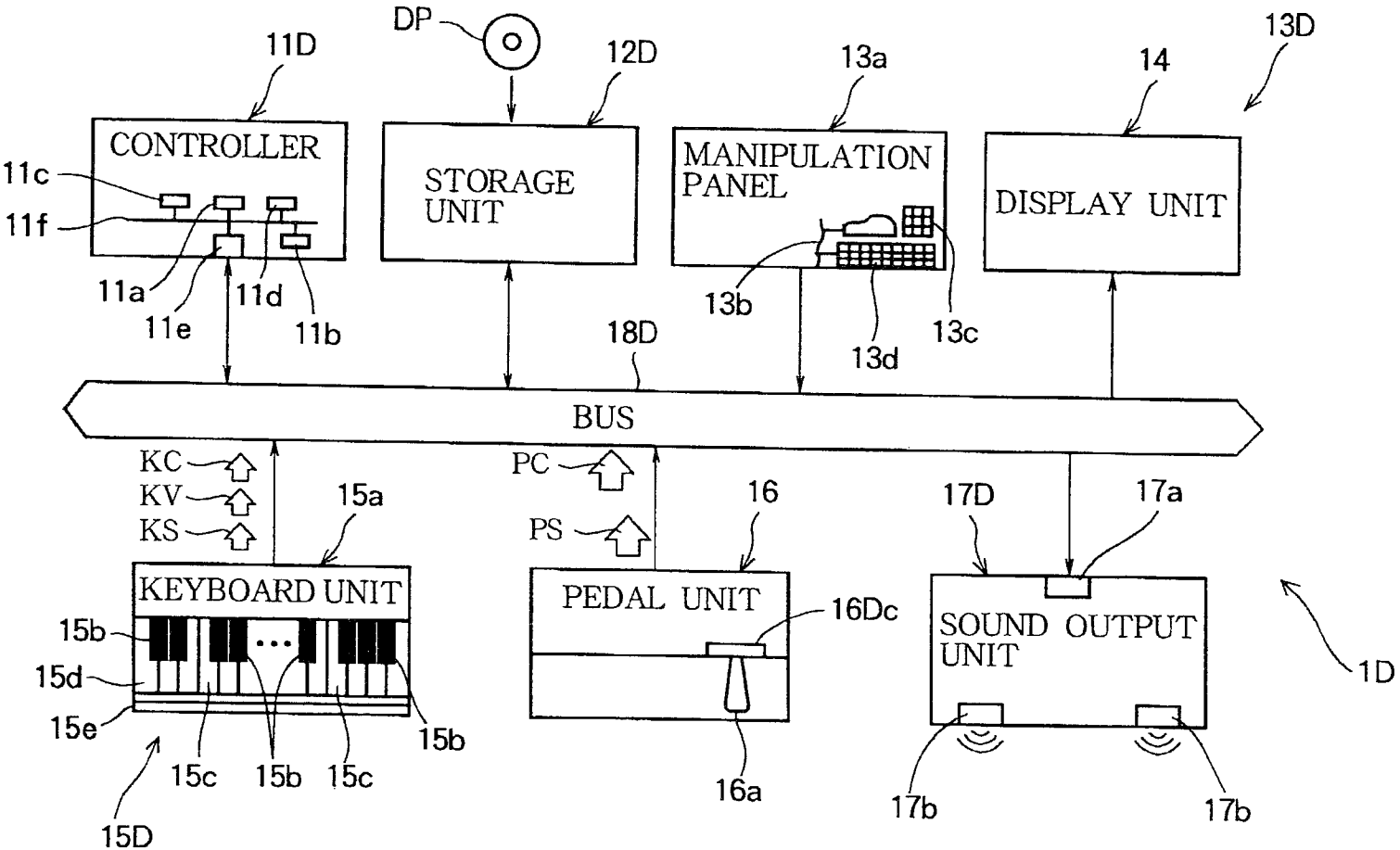
FIG. 12 is a block diagram showing a configuration of an electronic musical instrument according to modification 10 of the invention.

FIG. 12 is a block diagram showing a configuration of an electronic musical instrument 1D according to Modification 2 of the invention. The electronic musical instrument D1 is an electronic piano, for example, and includes a controller 11D, a storage unit 12D, a user manipulation unit 13D, a playing manipulation unit 15D, and a sound output unit 17D. These components are connected via a bus 18D. The user manipulation unit 13D, the sound output unit 17D and the bus 18D have the same functions as those of the user manipulation unit 13, the sound output unit 17 and the bus 18 of the electronic musical instrument 1 according to first (second or third) embodiment, explanations thereof are omitted.

The playing manipulation unit 15D is distinguished from the playing manipulation unit 15 according to the first (second or third) embodiment in that the shift pedal 16*b* has been removed from the playing manipulation unit 15D. Accordingly, a pedal position sensor 16Dc senses a pressing intensity of the damper pedal 16*a*. Other components in the playing manipulation unit 15D have the same functions as those of the playing manipulation unit 15 in the first (second or third) embodiment so that explanations thereof are omitted.

The storage unit 12D is different from the storage unit 12 according to the first (second or third) embodiment, and stores force $f_H(n\Delta t)$ of the hammer tip, which acts on the string surface. This value represents a value in the state that the shift pedal 16*b* is not pressed down (rest position) in the first (second or third) embodiment.

The controller 11D is different from the controller 11 according to the first (second or third) embodiment and implements a musical tone signal synthesis unit 100D without using the hammer model calculator 103 among musical tone signal synthesis units implemented by executing a control program.

Figure 13:
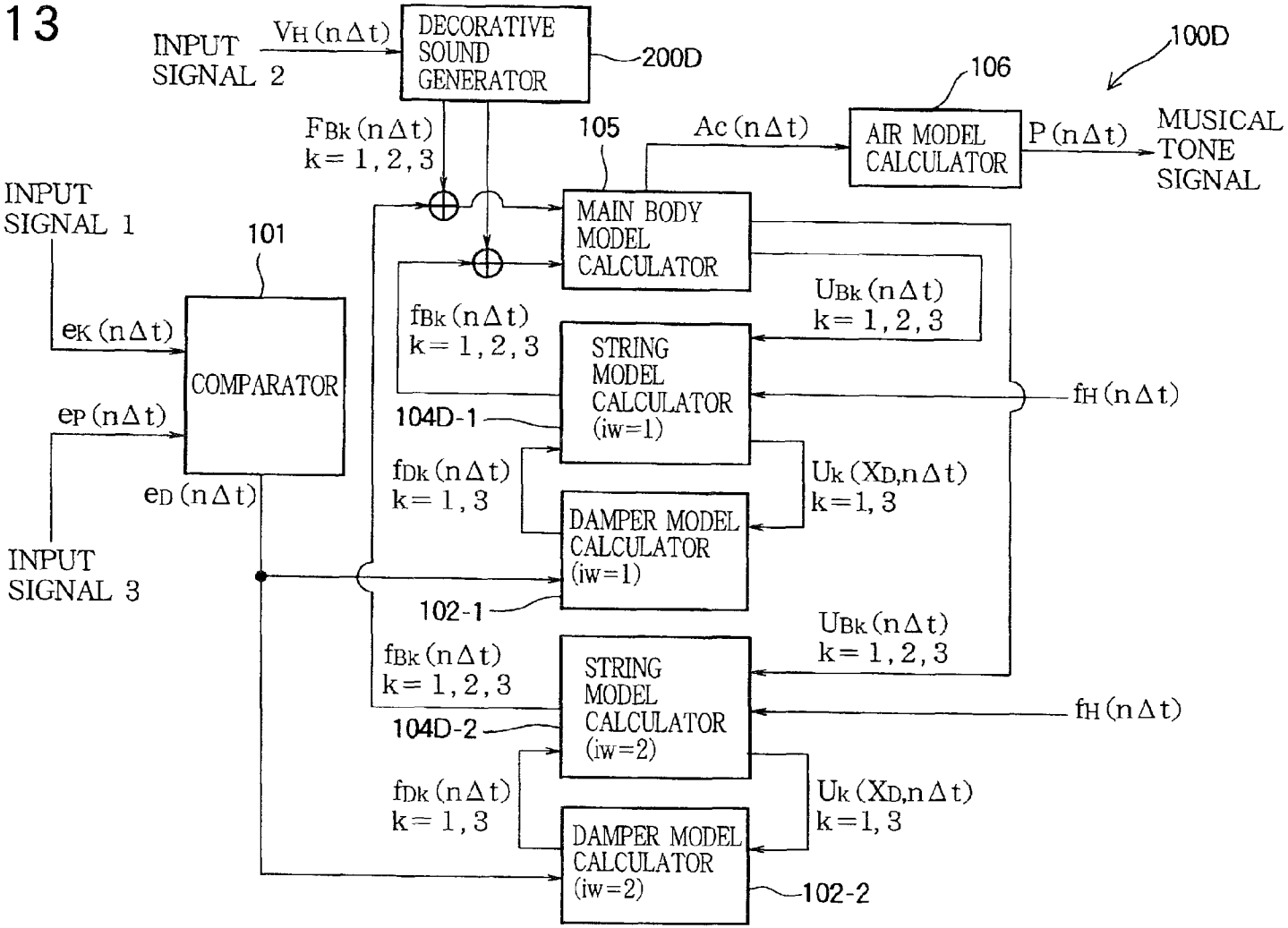
FIG. 13 is a block diagram showing a configuration of a musical tone signal synthesis unit according to modification 10 of the invention.

FIG. 13 is a block diagram showing a configuration of a musical tone signal synthesis unit 100D. As shown in FIG. 13, the musical tone signal synthesis unit 100D does not have the hammer model calculator 103. String model calculators 104D-1 and 104D-2 acquire $f_H(n\Delta t)$ stored in the storage unit 12D instead of $f_H(n\Delta t)$ output from the hammer model calculator 103. A decorative sound generator 200D receives the second input signal $V_H(n\Delta t)$ and does not accept the fourth input signal $e_S(n\Delta t)$. That is, the waveform data stored in the storage unit 12D is not related to a pressing intensity of the shift pedal and corresponds to the number of the key 21*a*. Other components in the musical tone signal synthesis unit 100D have the same functions as those of the musical tone signal synthesis unit 100 according to the first (second or third) embodiment so that explanations thereof are omitted.

It is possible to implement a configuration having no shift pedal by fixing $e_S(n\Delta t)=1$ (fixing the shift pedal to the rest position) in the musical tone signal synthesis unit 100 according to the first (second or third) embodiment without using the configuration having no hammer model calculator.

Modification 11

An electronic musical instrument having a configuration in which the damper pedal 16*a* in the first (second or third) embodiment has been removed may be used. The configuration in this case will now be explained with reference to FIGS. 14 and 15.

Figure 14:
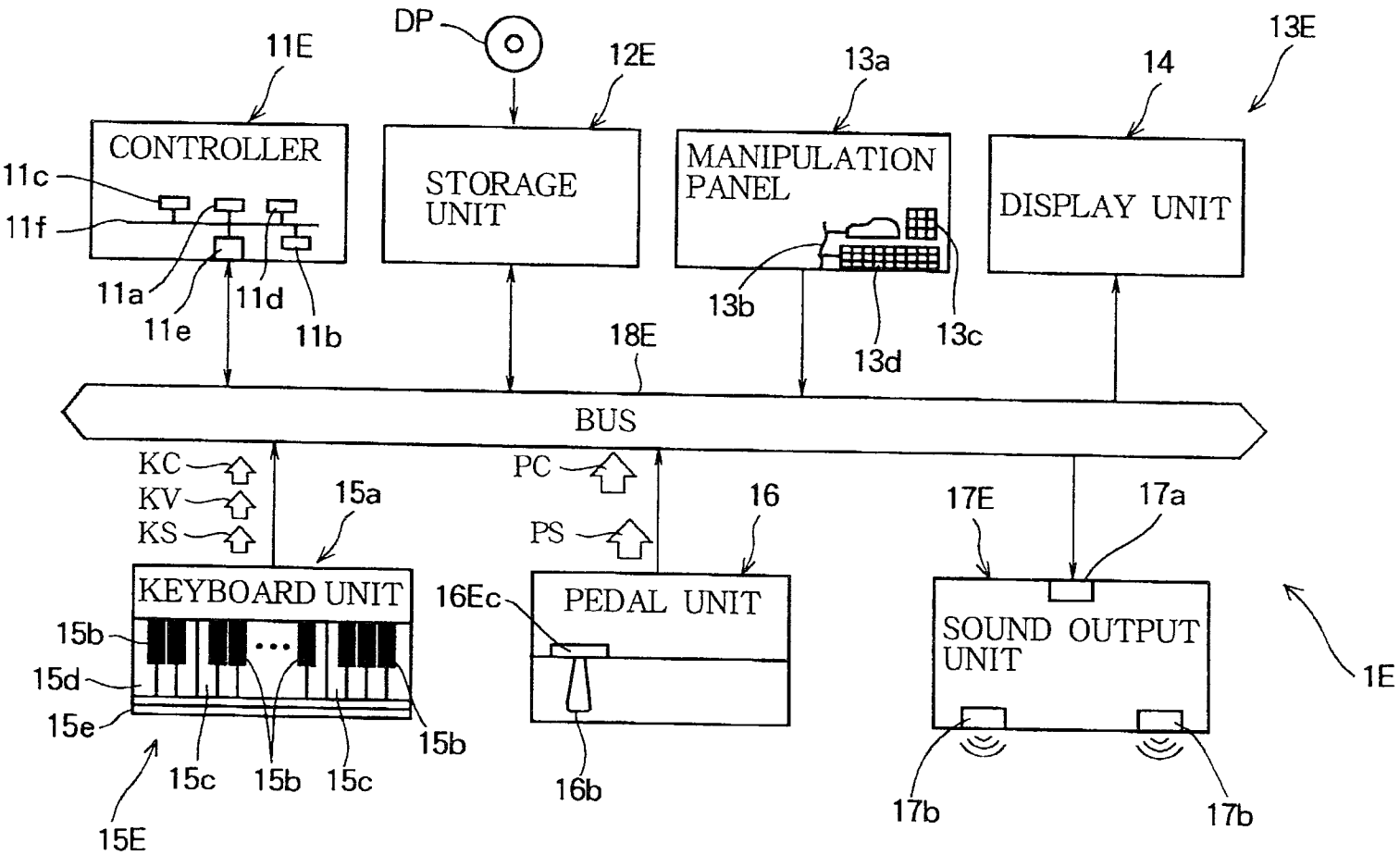
FIG. 14 is a block diagram showing a configuration of an electronic musical instrument according to modification 11 of the invention.

FIG. 14 is a block diagram showing a configuration of an electronic musical instrument 1E according to Modification 3 of the invention. The electronic musical instrument 1E is an electronic piano, for example, and includes a controller 11E, a storage unit 12E, a user manipulation unit 13E, a playing manipulation unit 15E, and a sound output unit 17E. These components are connected via a bus 18E. The user manipulation unit 13E, the sound output unit 17E and the bus 18E have the same functions as those of the user manipulation unit 13, the sound output unit 17 and the bus 18 in the electronic musical instrument 1 according to the first (second or third) embodiment so that explanations thereof are omitted.

The playing manipulation unit 15E is different from the playing manipulation unit 15 in the first (second or third) embodiment, and the damper pedal 16*a* has been removed from the playing manipulation unit 15E, and thus a pedal position sensor 16Ec senses a pressing intensity of the shift pedal 16*b*. Other components in the playing manipulation unit 15E have the same functions as those of the playing manipulation unit 15 according to the first (second or third) embodiment so that explanations thereof are omitted.

The storage unit 12E is different from the storage unit 12 in the first (second or third) embodiment and stores damper resistance $f_{Dk}(n\Delta t)$. This value represents a value in the state that the damper pedal 16*a* according to the first (second or third) embodiment is not pressed down (rest position).

The controller 11E is different from the controller 11 in the first (second or third) embodiment and implements a musical tone signal synthesis unit 100E that does not use the comparator 101 and the damper model calculators 102-1 and 102-2 among musical tone signal synthesis units 100 implemented by executing the control program.

Figure 15:
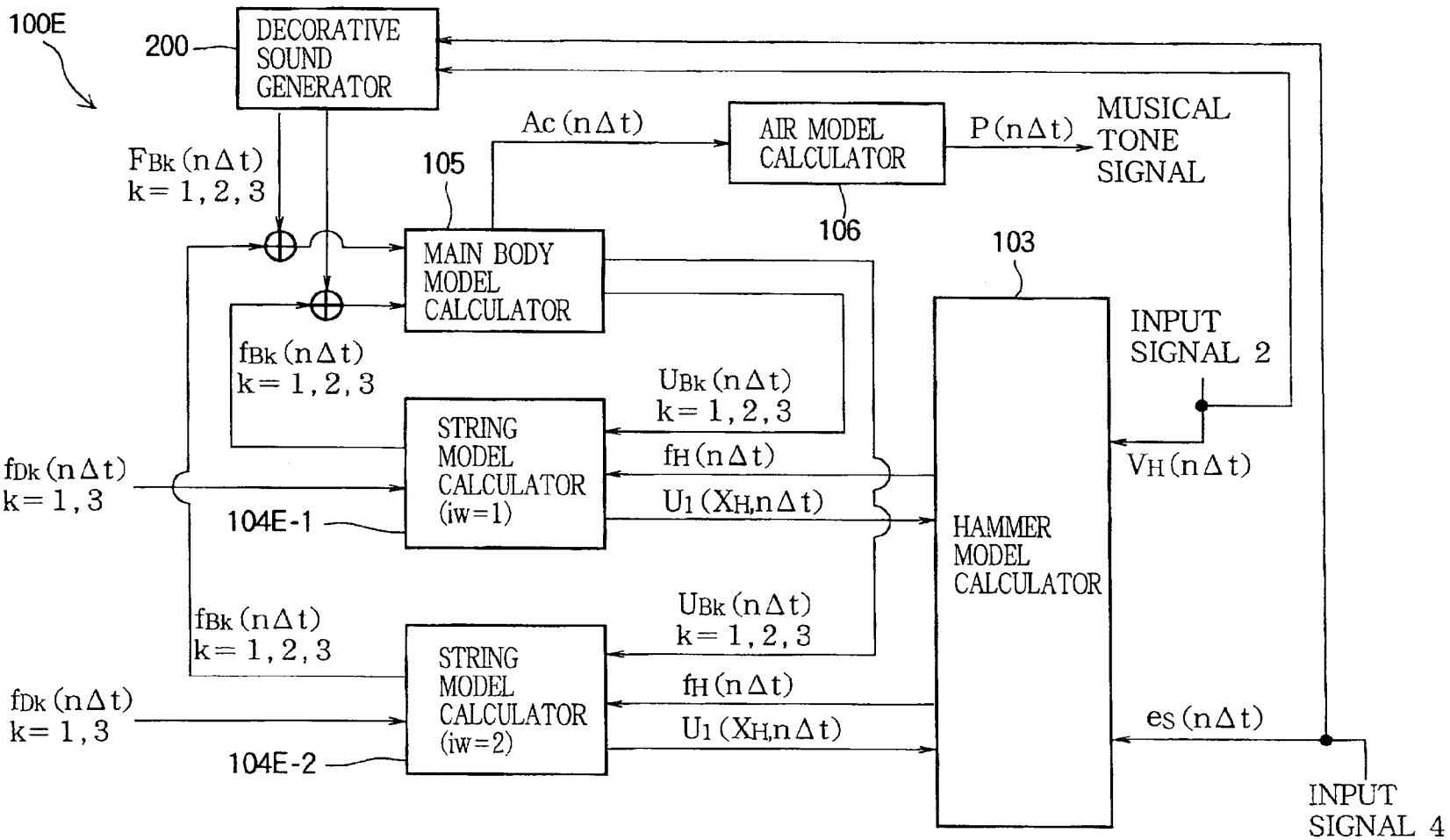
FIG. 15 is a block diagram showing a configuration of a musical tone signal synthesis unit according to modification 11 of the invention.

FIG. 15 is a block diagram showing a configuration of the musical tone signal synthesis unit 100E. As shown in FIG. 15, the musical tone signal synthesis unit 100E does not include the comparator 101 and the damper model calculators 102-1 and 102-2. String model calculators 104E-1 and 104E-2 receive $f_{Dk}(n\Delta t)$ stored in the storage unit 12E instead of $f_{Dk}(n\Delta t)$ output from the damper model calculator 102. Other components in the musical tone signal synthesis unit 100E have the same functions as those of the musical tone signal synthesis unit 100 according to the first (second or third) embodiment so that explanations thereof are omitted.

It is possible to implement a configuration having no damper pedal by fixing $e_P(n\Delta t)=1$ (fixing the damper pedal to the rest position) in the musical tone signal synthesis unit 100 according to the first (second or third) embodiment without using the configuration that does not include the comparator 101 and the damper model calculators 102-1 and 102-3.

Modification 12

An electronic musical instrument having a configuration in which the damper pedal 16*a* and the shift pedal 16*b* in the first (second or third) embodiment have been removed may be used. The configuration in this case will now be explained with reference to FIGS. 16 and 17.

Figure 16:
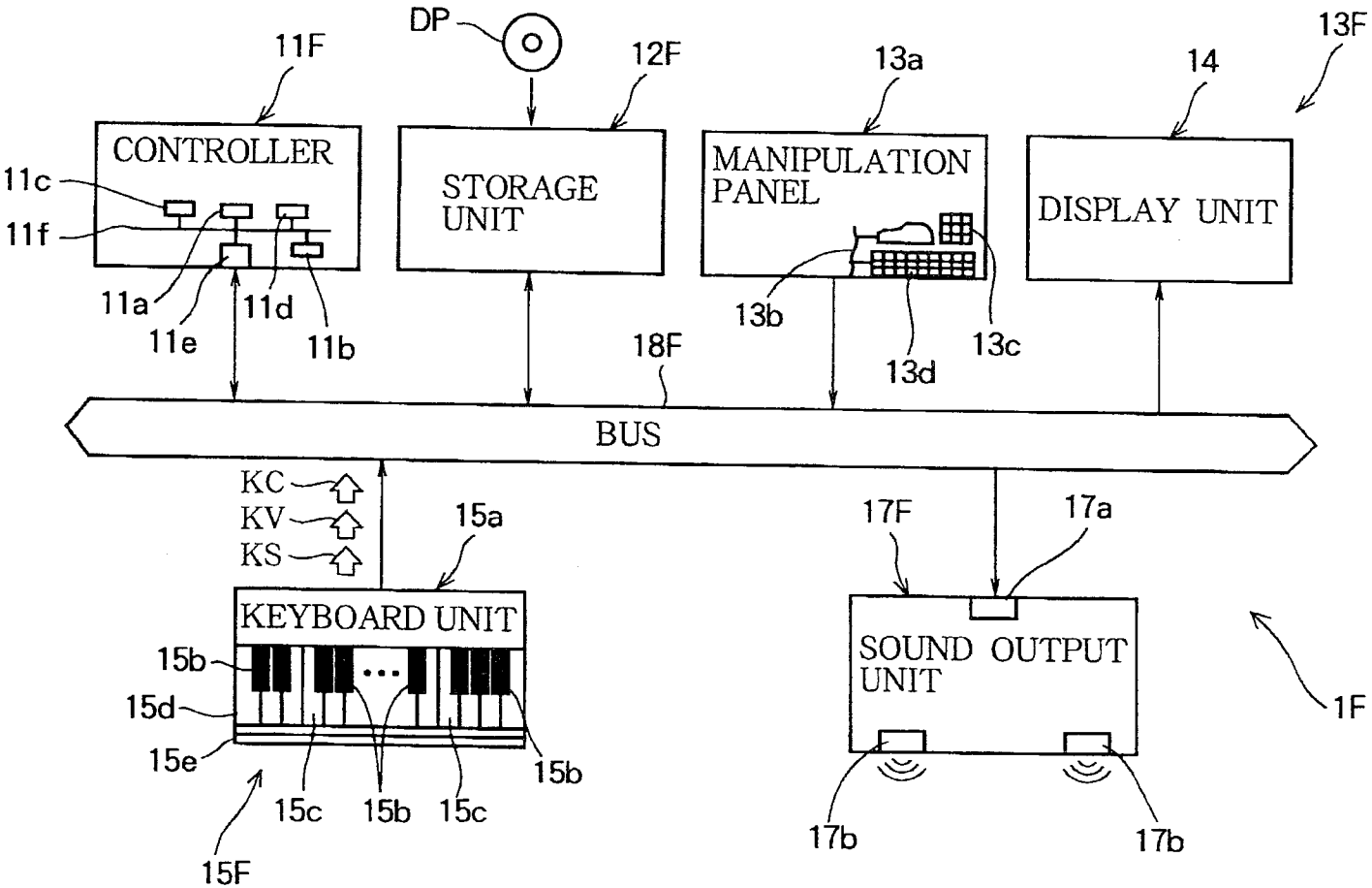
FIG. 16 is a block diagram showing a configuration of an electronic musical instrument according to modification 12 of the invention.

FIG. 16 is a block diagram showing a configuration of an electronic musical instrument 1F according to Modification 4 of the invention. The electronic musical instrument 1F is an electronic piano, for example, and includes a controller 11F, a storage unit 12F, a user manipulation unit 13F, a playing manipulation unit 15F, and a sound output unit 17F. These components are connected via a bus 18F. The user manipulation unit 13F, the sound output unit 17F and the bus 18F have the same functions as those of the user manipulation unit 13, the sound output unit 17 and the bus 18 in the electronic musical instrument 1 according to the first (second or third) embodiment so that explanations thereof are omitted.

The playing manipulation unit 15F is different from the playing manipulation unit 15 in the first (second or third) embodiment, and the pedal unit 16 has been removed from the playing manipulation unit 15F, and thus a pedal position sensor is not present in the playing manipulation unit 15F. Other components in the playing manipulation unit 15F have the same functions as those of the playing manipulation unit 15 according to the first (second or third) embodiment so that explanations thereof are omitted.

The storage unit 12F is different from the storage unit 12 in the first (second or third) embodiment and stores damper resistance $f_{Dk}(n\Delta t)$ and the force of the hammer tip acting on the string surface, $f_H(n\Delta t)$. These values represent values in the state that the damper pedal 16*a* and the shift pedal 16*b* according to the first (second or third) embodiment are not pressed down (rest position).

The controller 11F is different from the controller 11 in the first (second or third) embodiment and implements a musical tone signal synthesis unit 100F that does not use the comparator 101, the damper model calculators 102-1 and 102-2, and the hammer model calculator 103 among the musical tone signal synthesis units 100 implemented by executing the control program.

Figure 17:
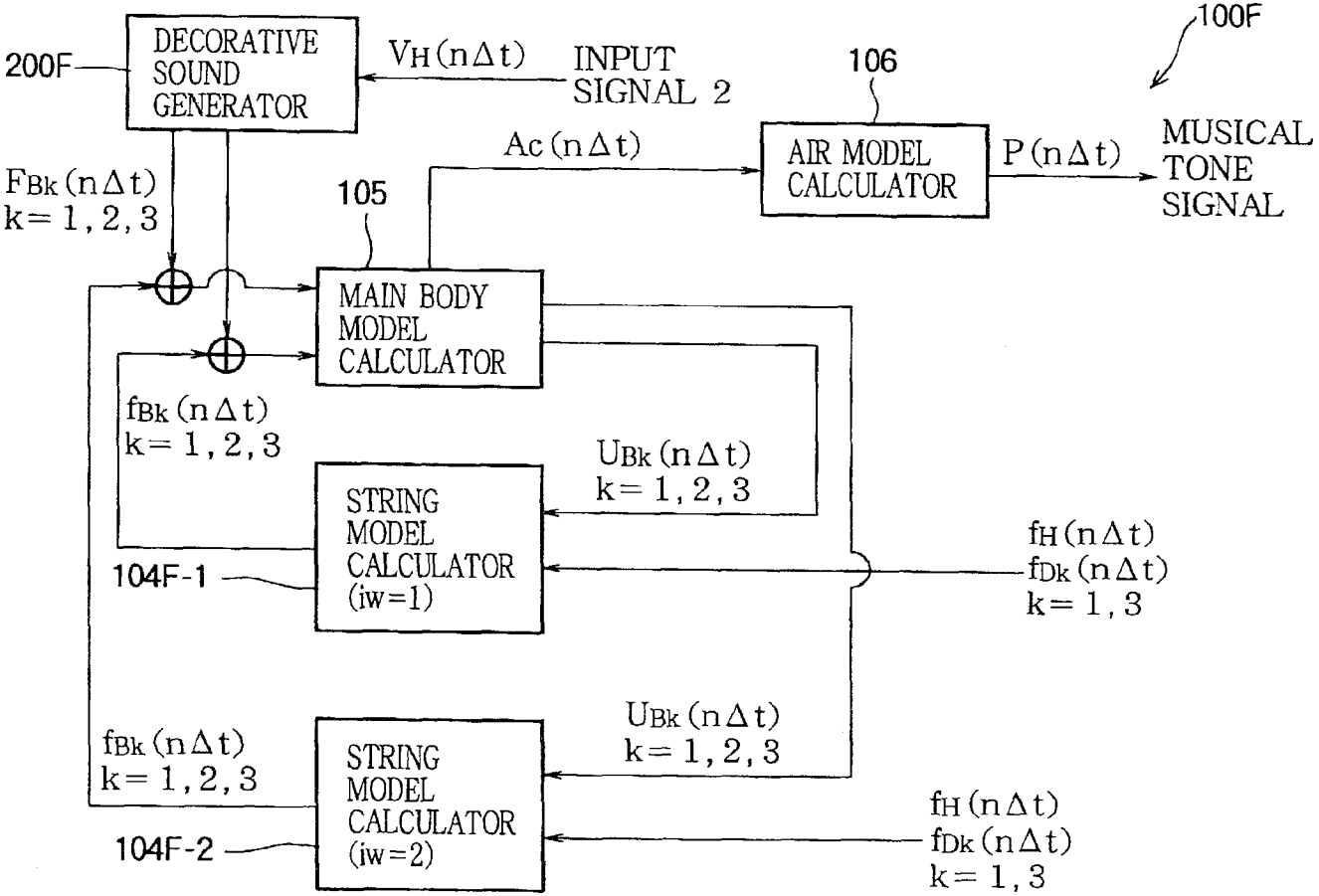
FIG. 17 is a block diagram showing a configuration of a musical tone signal synthesis unit according to modification 12 of the invention.

FIG. 17 is a block diagram showing a configuration of a musical tone signal synthesis unit 100F. As shown in FIG. 17, the musical tone signal synthesis unit 100F does not include the comparator 101, the damper model calculators 102-1 and 102-2, and the hammer model calculator 103. String model calculators 104F-1 and 104F-2 receive $f_{Dk}(n\Delta t)$ and $f_H(n\Delta t)$ stored in the storage unit 12F instead of $f_{Dk}(n\Delta t)$ output from the damper model calculator 102 and $f_H(n\Delta t)$ output from the hammer model calculator 103. A decorative sound generator 200F receives the second input signal $V_H(n\Delta t)$ and does not accept the fourth input signal $e_S(n\Delta t)$. That is, the waveform data stored in the storage unit 12F is not related to a pressing intensity of the shift pedal and corresponds to the number of the key 21*a*. Other components in the musical tone signal synthesis unit 100F have the same functions as those of the musical tone signal synthesis unit 100 according to the first (second or third) embodiment so that explanations thereof are omitted.

It is possible to implement a configuration having no damper pedal and shift pedal by fixing $e_S(n\Delta t)=1$ (fixing the shift pedal to the rest position) and fixing $e_P(n\Delta t)=1$ (fixing the damper pedal to the rest position) in the musical tone signal synthesis unit 100 according to the first (second or third) embodiment without using the configuration that does not include the comparator 101, the damper model calculators 102-1 and 102-3, and the hammer model calculator 103.

Modification 13

While the decorative sound generator 200 generates the decorative sound information that represents the force $F_{Bk}(n\Delta t)$ which acts on the string supports according to the decorative sound and corrects $f_{Bk}(n\Delta t)$ using the decorative sound information in the first (third) embodiment, the decorative sound generator 200 may generate decorative sound information that represents force acting on another portion of the main body according to the decorative sound. For example, a deck sound is generated due to collision of the key 21*a* and the deck 21*k*, and thus force $f_{Ek}(n\Delta t)$ which acts on the main body from the collision point, may be generated. A configuration of a musical tone signal synthesis unit 100G in this case will now be explained with reference to FIG. 18.

Figure 18:
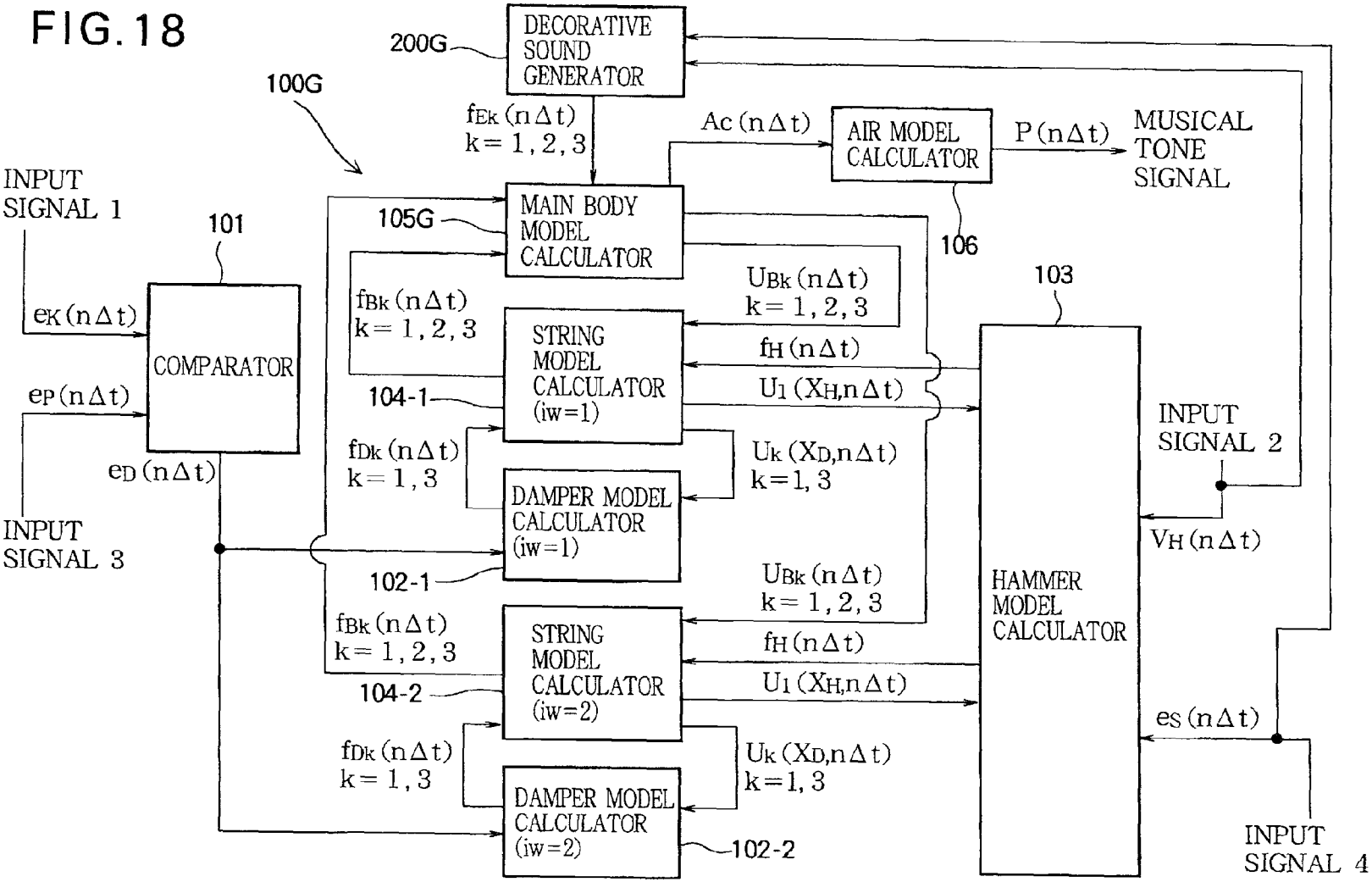
FIG. 18 is a block diagram showing a configuration of a musical tone signal synthesis unit according to modification 13 of the invention.

FIG. 18 is a block diagram showing the configuration of the musical tone signal synthesis unit 100G. The musical tone signal synthesis unit 100G have configurations of the air model calculator and the decorative sound generator, which are different from those of the air model calculator 106 and the decorative sound generator 200 in the musical tone signal synthesis unit 100 according to the first (second or third) embodiment. Other components in the musical tone signal synthesis unit 100G have the same functions as those of the musical tone signal synthesis unit 100 according to the first (second or third) embodiment so that explanations thereof are omitted.

A decorative sound generator 200G receives the second input signal $V_H(n\Delta t)$ and the fourth input signal $e_S(n\Delta t)$, generates decorative sound information that represents force $f_{Ek}(n\Delta t)$ (k=1, 2, 3) which acts on the main body from a collision point of the key according to the decorative sound, and outputs the decorative sound information to a main body model calculator 105G. The force $f_{Ek}(n\Delta t)$ has an index of $i_K$.

Here, waveform data read by a waveform reading unit of the decorative sound generator 200G from the storage unit 12 is different from the waveform data in the first embodiment. That is, while the waveform data in the first embodiment can be obtained by detecting the vibration waveform of the deck sound as displacements of the string supports, the waveform data in this Modification can be detected as a displacement of the main body at a portion where the main body collides with the key. The decorative sound generator 200G processes the waveform data and outputs the force $f_{Ek}(n\Delta t)$ which acts on the main body from the collision point of the key.

The waveform data may be generated using the method of Modification 1. Furthermore, the decorative sound generator 200G may calculate force generated when the key 21*a* collides with the deck 21*k* using a physical model and output the calculated force as $f_{Ek}(n\Delta t)$. In this case, a configuration using no waveform data may be implemented.

The main body model calculator 105G performs correction according to the decorative sound information output from the decorative sound generator 200G when the model calculation in the first embodiment is performed. In this example, the main body model calculator 105G performs the correction by multiplying $f_{Ek}(n\Delta t)$ by a coefficient $\mu_{Ek}^{[iK][m]}$ and adding the multiplication result to the right side of the equation (21) of motion for each mode of the main body. That is, the main body model calculator 105G performs a calculation using the above Equation (32) as the following Equation (41). $f_{Ek}(n\Delta t)$ may be set to 0 for k=2 and 3 such that an object of addition corresponds to k=1 only. Furthermore, the correction may be carried out through a combination of subtraction, weighting and then addition, integration, division, etc.

$$\left\{\frac{d^2}{dt^2} + 2\zeta_C^{[m]} w_C^{[m]} \frac{d}{dt} + (w_C^{[m]})^2\right\} A_C^{[m]}(t) = \sum_{i_K=1}^{I_K} \sum_{i_W=1}^{I_W^{[i_K]}} \sum_{i_B=0}^{1} \sum_{k=1}^{3} f_{Bk}^{[i_K][i_W][i_B]}(t) \hat{\phi}_{Bk}^{[i_K][i_W][i_B][m]} + \sum_{i_K=1}^{I_K} \sum_{k=1}^{3} f_{Ek}^{[i_K]}(t) \mu_{Ek}^{[i_K][m]} \tag{41}$$

$m = 1, 2, \ldots, M$ where $$\hat{\phi}_{Bk}^{[i_K][i_W][i_B][m]} = \sum_{k'}^{3} \beta_{k'k}^{[i_K][i_W]} \phi_{Bk}^{[i_K][i_W][i_B][m]}$$

$f_{E1}^{[i_K]}$: Z-direction component of force acting on the main body from a collision point of the key $f_{E2}^{[i_K]}$: X-direction component of the force acting on the main body from the collision point of the key $f_{E3}^{[i_K]}$: Y-direction component of the force acting on the main body from the collision point of the key $\mu_{E1}^{[i_K][m]}$: Coefficient of a Z-direction component of the natural vibration mode of the main body at the collision point of the key $\mu_{E2}^{[i_K][m]}$: Coefficient of an X-direction component of the natural vibration mode of the main body at the collision point of the key $\mu_{E3}^{[i_K][m]}$: Coefficient of a Y-direction component of the natural vibration mode of the main body at the collision point of the key As described above, the force acting on the main body according to the decorative sound is not limited to the string supports and it may act on any portion of the main body.

Modification 14

While musical tone signal synthesis processing is performed in real time such that the electronic musical instrument 1 outputs a sound according to operations of the keyboard 15*a* and the pedal unit 16, for example, in the first (second or third) embodiment, non-real-time processing may be carried out when a sound is output depending on musical tone control data.

In this case, it is possible to use musical tone control data corresponding to one piece of music, for example, calculate "velocity data on the time base for each natural vibration mode of the main body of a musical instrument" in advance, and perform convolution of the velocity data and "data of impulse response or frequency response between the natural vibration mode of the main body and the observation point in the air" from the back. This means that musical tone synthesis in the case where only the position of the observation point is changed can be easily performed.

Modification 15

While a musical ton signal that simulates a sound of the piano is synthesized in the first (second or third) embodiment, the present invention is not limited to the piano and may be applied to any musical instrument (for example, cembalo, stringed instrument, guitar, etc.) if it is a musical instrument in a three-dimensional structure having vibrating strings and a main body that supports the strings and receive vibration of the strings to emit sounds to the air. When a pillar (corresponding to the bridge of the piano) is provided between two ends of a musical instrument, over which strings are extended, such as a stringed instrument, one of string supports becomes the pillar.

Furthermore, even if a musical tone signal that simulates a sound of a musical instrument other than the piano is synthesized, a musical tone signal including parts of a sound generated by vibration of the main body as a decorative sound can be synthesized. For example, in the case of a guitar, a musical tone signal of a sound considering coupled vibration of the sound box (main body) and strings when the main body is beaten is synthesized.

Modification 16

The control program in the first (second or third) embodiment may be provided being stored in a computer readable recording medium such as a magnetic recording medium (magnetic tape, magnetic disc, etc.), an optical recording medium (optical disc, etc.), a magneto-optical recording medium, a semiconductor memory, etc. Furthermore, the electronic musical instrument 1 may download the control program via a network.

What is claimed is:

1. A musical tone signal synthesis method of synthesizing a musical tone signal based on performance information, the musical tone signal simulating a sound generated from a musical instrument having a three-dimensional structure including a string that undergoes vibration and a main body having two string supports, between which the string is stretched, the vibration traveling from the string to the main body through at least one of the string supports, the musical tone signal synthesis method comprising:

a string model calculation process of inputting an excitation signal based on the performance information to a closed loop having a delay element that simulates delay characteristic of the vibration propagated through the string and a characteristic control element that simulates a variation in amplitude characteristics or frequency characteristics associated to propagation of the vibration, and calculating first information representing a force of the string acting on at least one of the string supports on the basis of a cyclic signal circulating in the closed loop and representing the vibration of the string;

a main body model calculation process of calculating second information representing, on modal coordinates, a displacement of each vibration mode of the main body or representing an nth order derivative (n=1, 2, . . . ) of the displacement with time, on the basis of an equation of motion that represents the vibration of the main body caused by the force of the string represented by the first information; and a musical tone signal calculation process of calculating the musical tone signal on the basis of the second information.

2. The musical tone signal synthesis method according to claim 1, wherein the main body model calculation process calculates, on the basis of the second information, third information that represents a displacement of at least one of the string supports or an nth order derivative of the displacement thereof (n=1, 2, . . . ) with time, and wherein the string model calculation process inputs an excitation signal based on the third information to the closed loop in addition to the excitation signal based on the performance information.

3. The musical tone signal synthesis method according to claim 1, wherein the musical instrument is a piano having a key depressed to collide with the main body and a hammer that strikes a specific point of the string according to depression of the key, wherein the method further comprises a hammer model calculation process of calculating fifth information that represents a force of the hammer acting on the string, on the basis of a position of the hammer determined according to the performance information and on the basis of fourth information that represents a displacement at the specific point of the string, and wherein the string model calculation process inputs an excitation signal based on the fifth information as the excitation signal based on the performance information, and calculates the fourth information on the basis of the cyclic signal.

4. The musical tone signal synthesis method according to claim 1, wherein the musical tone signal calculation process acquires sixth information that represents an impulse response of a sound pressure at an observation point in the air caused by the displacement of each vibration mode of the main body or the nth order derivative (n=1, 2, . . . ) of the displacement with time, then performs convolution of the second information calculated in the main body model calculation process and the sixth information for each vibration mode of the main body, and calculates the sound pressure at the observation point in the air as the musical tone signal by combining results of the convolution.

5. A machine readable storage medium for use in a computer, the medium containing program instructions executable by the computer to perform a musical tone signal synthesis of a musical tone signal based on performance information, the musical tone signal simulating a sound generated from a musical instrument having a three-dimensional structure including a string that undergoes vibration and a main body having two string supports, between which the string is stretched, the vibration traveling from the string to the main body through at least one of the string supports, the musical tone signal synthesis comprising:

a string model calculation process of inputting an excitation signal based on the performance information to a closed loop having a delay element that simulates delay characteristic of the vibration propagated through the string and a characteristic control element that simulates a variation in amplitude characteristics or frequency characteristics associated to propagation of the vibration, and calculating first information representing a force of the string acting on at least one of the string supports on the basis of a cyclic signal circulating in the closed loop and representing the vibration of the string;

a main body model calculation process of calculating second information representing, on modal coordinates, a displacement of each vibration mode of the main body or representing an nth order derivative (n=1, 2, . . . ) of the displacement with time, on the basis of an equation of motion that represents the vibration of the main body caused by the force of the string represented by the first information; and a musical tone signal calculation process of calculating the musical tone signal on the basis of the second information.

6. A musical tone signal synthesis apparatus for synthesizing a musical tone signal based on performance information, the musical tone signal simulating a sound generated from a musical instrument having a three-dimensional structure including a string that undergoes vibration and a main body having two string supports, between which the string is stretched, the vibration traveling from the string to the main body through at least one of the string supports, the musical tone signal synthesis apparatus comprising:

a closed loop portion having a delay element that simulates delay characteristic of vibration propagated through the string and a characteristic control element that simulates a variation in amplitude characteristics or frequency characteristics associated to propagation of the vibration;

a string model calculation portion that inputs an excitation signal based on the performance information to the closed loop portion, and that calculates first information representing a force of the string acting on at least one of the string supports on the basis of a cyclic signal circulating in the closed loop and representing the vibration of the string;

a main body model calculation portion that calculates second information representing, on modal coordinates, a displacement of each vibration mode of the main body or representing an nth order derivative (n=1, 2, . . . ) of the displacement with time, on the basis of an equation of motion that represents the vibration of the main body caused by the force of the string represented by the first information; and a musical tone signal calculation portion that calculates the musical tone signal on the basis of the second information.

* * * * *